US008117780B2

(12) United States Patent
Matthews et al.

(10) Patent No.: US 8,117,780 B2
(45) Date of Patent: Feb. 21, 2012

(54) GUN SIGHT

(75) Inventors: John W. Matthews, Newport Beach, CA (US); Mark Buczek, Oceanside, CA (US); Mark Squire, San Diego, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 12/785,781

(22) Filed: May 24, 2010

(65) Prior Publication Data

US 2011/0283589 A1 Nov. 24, 2011

(51) Int. Cl.
*B64F 1/00* (2006.01)

(52) U.S. Cl. ..... 42/114; 42/123; 42/131; 42/132; 42/140

(58) Field of Classification Search ..... 42/114, 42/132, 122, 123, 130, 131, 140
See application file for complete search history.

(56) References Cited

U.S. PATENT DOCUMENTS

| | | | | |
|---|---|---|---|---|
| 3,645,635 | A * | 2/1972 | Steck | 356/252 |
| 4,806,007 | A | 2/1989 | Bindon | |
| 5,924,234 | A | 7/1999 | Bindon et al. | |
| 6,490,060 | B1 | 12/2002 | Tai et al. | |
| 7,069,685 | B2 | 7/2006 | Houde-Walter | |
| 7,325,354 | B2 * | 2/2008 | Grauslys et al. | 42/131 |
| 7,721,481 | B2 * | 5/2010 | Houde-Walter | 42/131 |
| 7,796,329 | B2 * | 9/2010 | Dobschal et al. | 359/399 |
| 2005/0057808 | A1 | 3/2005 | Houde-Walter | |
| 2010/0095578 | A1 | 4/2010 | Elpedes et al. | |

FOREIGN PATENT DOCUMENTS

GB 1 579 796 11/1980

OTHER PUBLICATIONS

U.S. Appl. No. 12/914,597, Matthews et al.
msnbc.com, New device could improve marksmanship, http://www.msnbc.msn.com/id/34384750/ns/technology_and_science-innovation/, pp. 1-2, Dec. 11, 2009.
Texas Instruments DLP in the Optoma Pico-Projector, Technology Insider, http://chipworks.com/blogs.aspx?id=5618&blogid=86, pp. 1-2, Jan. 12, 2009.

(Continued)

*Primary Examiner* — J. Woodrow Eldred
(74) *Attorney, Agent, or Firm* — Haynes and Boone, LLP

(57) ABSTRACT

Various gun sights for firearms and related methods of use are provided. In one embodiment, the sight includes an apparatus adapted to be mounted at a rear end of a firearm and arranged to occlude one eye of a user of the firearm and to generate an illuminated dot that is disposed such that it is generally centered on the longitudinal axis of the barrel of the firearm. The gun sight produces a collimated beam of light that creates an image of an illuminated dot by either a refractive method or a reflective method. In use, a dominant eye of the user is occluded by the sight and the other eye of the user is focused on the target. The user then adjusts the position of the gun relative to the target such that the user perceives the illuminated dot of the sight to be positioned on the target. In one embodiment the sight includes a dry fire detector that generates some output to the user, such as an increase in brightness of the illuminated dot, at the instant the weapon would have fired if a round had been in the chamber.

20 Claims, 26 Drawing Sheets

OTHER PUBLICATIONS

Reticle, http://en.wikipedia.org/wiki/Reticle, pp. 1-4, Jul. 22, 2009.
Reflex sight, http://en.wikipedia.org/wiki/Reflex_sight, pp. 1-4, Jul. 24, 2009.
Advanced Combat Optical Gunsight, http://en.wikipedia.org/wiki/Advanced_Combat_Optical_Gunsight, pp. 1-3, May 15, 2010.
American Rifleman, Burris Eliminator Laserscope, Aug. 2011, pp. 86-87.
Schmidt-Pechan prism, http://en.wikipedia.org/wiki/Schmidt%E2%80%93Pechan_prism, Aug. 21, 2011, pp. 1-3.
Telescopic sight, http://en.wikipedia.org/wiki/Telescopic_sight, pp. 1-15, Oct. 18, 2011.
U.S. Appl. No. 13/281,166, title: Sight System, filed: Oct. 25, 2011, inventors: Matthews et al., 81 pages.

* cited by examiner

| FIG. 39A | FIG. 39B |
|---|---|

KEY TO FIG. 39

GUN SIGHT

BACKGROUND

1. Field of the Invention

The present invention relates to weapon sighting devices in general, and more particularly to sights for use on firearms.

2. Related Art

Over the years, sighting devices have been developed to permit the user of small arms such as rifles, muskets, revolvers, shotguns, machine guns, and pistols, to align the weapon accurately relative to a target such that a projectile fired from the weapon may hit the target reliably.

Such sighting devices, or gun sights, may be seen as falling into two broad groups, namely, "active" and "passive" sights. Active sights typically illuminate the target with some form of radiation, and rely on a reflection of the radiation from the target to ensure correct alignment of the weapon with the target. An example of an active sight is commonly referred to as a laser sight. A laser sight generates a beam of laser light that is projected onto the target field such that the light beam actually illuminates the point of impact at a certain range. Such sights are highly effective in certain conditions, but suffer from a number of disadvantages. For example, depending on conditions the target may be able to see the light beam or its reflection, and when there are multiple weapons illuminating the same target it may become difficult for each user to know which reflection is associated with which firearm.

Passive sights typically rely on ambient illumination of the target and include the familiar open sights or "iron sights" comprising a front sight (e.g., a dispart sight such as a blade or tang disposed at the front end of the barrel of the weapon) and a rear sight (e.g., a complementary notch, groove, or circular aperture disposed at the rear end of the receiver or slide of the weapon). Passive sights also include "telescopic" sights that use a reticle, such as a set of adjustable "crosshairs" disposed inside the optics of a magnifying or non-magnifying telescope.

One type of passive sight, commonly referred to as a reflex sight, uses a refractive or reflective optical system to generate a collimated beam of light that is projected toward the user to create an illuminated reticle. The resulting plane wave seen by the user appears as a small, approximately circular disc of light that is focused at infinity. In a standard open reflex sight this illuminated reticle is projected such that it is superimposed over the field of view observed through the sight. This allows the user to see the target field through the sight as well as the illuminated reticle (e.g. an illuminated red dot) in one eye simultaneously. This gives the user a theoretically parallax-free image of the reticle, superimposed over the field of view through the sight.

Another type of passive gun sight that is particularly advantageous in close combat and similar situations is often referred to as an "occluded eye gun sight" (OEG). A common form of an OEG is essentially a closed reflex sight, in which the field of view through the sight is occluded such that the user sees the illuminated dot of the reflex sight superimposed over a blank background instead of an open field of view through the sight. When using such an OEG, the user's dominant eye is positioned behind the OEG and focused on the illuminated dot. That dominant eye is blocked or occluded by the OEG such that it does not see the target and instead sees only the illuminated dot.

The user's other eye is not obscured by the OEG and is focused on the target. When aiming the firearm, the user's brain superimposes the illuminated dot seen by the occluded dominant eye onto the target seen with by the user's other eye such that if the firearm is properly oriented the illuminated dot appears to the user to be projected onto the target. Effective use of an OEG requires both of the user's eyes, sometimes referred to as binocular vision. One example of a commercially available OEG for use on rifles, handguns, and grenade launchers, is the Trijicon "Arenson O.E.G.®" OEGs have significant advantages over other types of sighting devices in high-stress and close combat situations that require extremely fast target acquisition without compromising the user's overall situation awareness.

Like other prior art OEGs, the Arenson O.E.G. mounts on either the side or the top of the receiver of the weapon. However, neither of these arrangements is a natural location for binocular viewing, and mounting an OEG on the top of the receiver interferes with the use of conventional open sights. These mounting arrangements also change the balance of the firearm, require the use of a custom or modified holster, and require the use of a substantially modified shooting position depending on which sighting device is being used. The term OEG may be used herein to refer to a sight designed to be used as an occluded eye gun sight or to a standard reflex sight that may be occluded such that it can be used as an occluded eye gun sight.

Accurate use of all firearms requires extensive repetitive use. However, the use of live ammunition for training is expensive and requires access to a shooting range. Dry firing—firing the weapon without ammunition—may be an effective training exercise because it allows for the repetition needed to develop muscle memory, and the user may practice in a wide range of locations and situations. However, absent highly specialized and expensive training simulation systems, dry firing does not provide real-time user feedback regarding the accuracy of the practice "shot." This lack of user feedback significantly undermines the value of dry fire training.

A long felt but as yet unsatisfied need therefore exists for an improved sighting device that overcomes the disadvantages of prior art sighting devices and provides for improved dry fire training.

SUMMARY

Various gun sights for firearms and related methods of use are provided. In one embodiment, an optical sight for a handgun is provided. The sight includes a light source. The sight also includes an optical system that projects an approximately collimated beam of light from the light source toward a user of the sight to create an image of an illuminated reticle. The optical sight is positioned behind a barrel of the handgun such that it is generally centered on a longitudinal axis of the barrel of the handgun. Other embodiments are also provided as further disclosed herein.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

The following description is presented to permit any person skilled in the art to make and use the invention. For purposes of explanation, specific nomenclature is set forth to provide a thorough understanding of various embodiments of the invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the invention is not intended to be limited to the embodiments shown, but is to be accorded the widest possible scope consistent with the principles and features disclosed herein.

In one exemplary embodiment of the present invention, a reflex sight, shown here as an opaque or occluded eye gun sight (OEG), is positioned on a firearm such that the illuminated reticle or dot is disposed such that it is substantially centered on the longitudinal axis of the barrel of the gun. In the various example embodiments described below, the general description is made in the context of an M1911 45 caliber Colt/Browning automatic pistol. However, it should be understood that the invention described herein may be utilized with a wide variety of firearms, including automatic pistols with and without exposed hammers (striker fired) and including automatic pistols manufactured by Glock, Smith & Wesson, Colt, Beretta, Ruger, Desert Arms, SIG-Sauer, Steyr, Israel Weapon Industries, and others where appropriate. Discussion herein at times refers to an OEG, but those of skill in the art will understand that the concepts disclosed are equally applicable to any reflex or similar type of sight.

Figure 2:
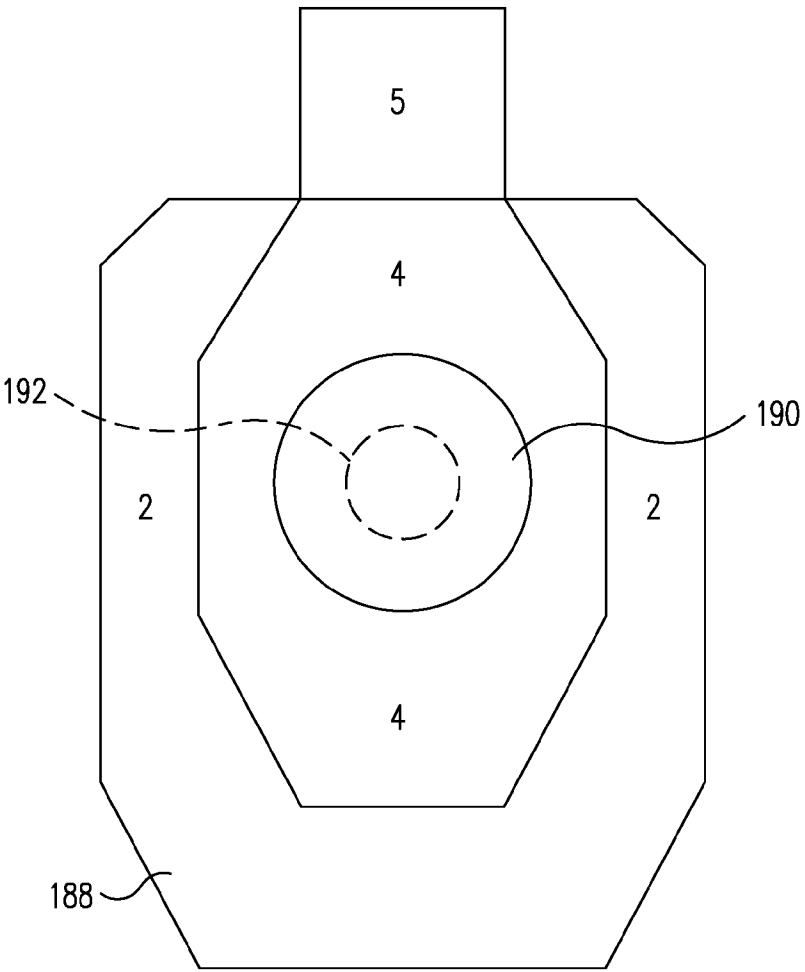
FIGS. 1-2 illustrate various uses of an OEG in accordance with embodiments of the invention.
Figure 1:
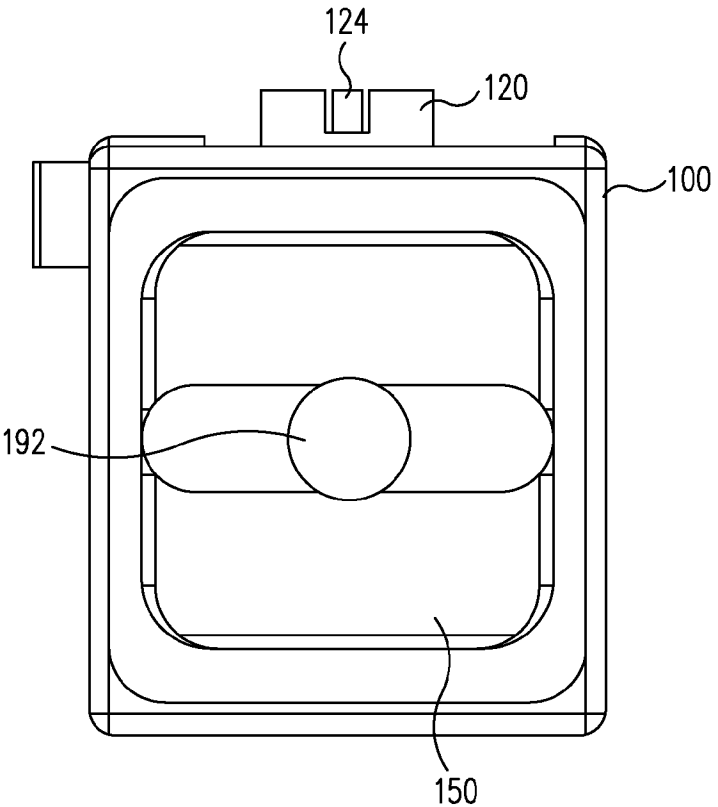

Unlike most dispart and telescopic sights, which require the user to close one eye and sight the firearm through their other eye, OEGs require binocular vision. Thus, the user must have both eyes open when sighting the weapon. Referring to FIGS. 1 and 2, the use of an OEG 100 will be described. FIG. 1 shows an OEG 100 from the user's perspective, with the rear sight 120 (e.g., a conventional notched iron sight or other appropriate sight) and front sight 124 (e.g., a conventional dispart iron sight or other appropriate sight) visible above the OEG 100. FIG. 2 shows a target field 188 in the form of a typical cut-out paper or cardboard target.

With reference to both FIGS. 1 and 2, one eye of the user is used to view the target field 188, including the specific desired point of impact 190. The second eye, typically the user's dominant eye, is positioned behind the OEG 100 such that the OEG 100 obscures the view of the target field 188 from that second eye. The OEG 100 includes some form of an indicator that is viewed with the user's second eye. This indicator is typically an illuminated feature such as an illuminated dot 192, most commonly formed by a beam of collimated light that is projected toward the user's eye from the OEG. This indicator will commonly be referred to herein as an illuminated dot, an aim dot, or a reticle, but it will be understood by those skilled in the art that the indicator may take a wide variety of forms including various shapes and/or colors. The user's second eye thus sees the lens assembly 150 and the illuminated dot 192 of the OEG 100, but does not see the target field 188. The user's first eye sees the target field 188 but does not see the OEG 100.

The two different images seen by the user's first eye and second eye are then superimposed by the user's brain, such that when the OEG 100 is properly positioned relative to the target field the user "sees" the illuminated dot 192 of the OEG 100 superimposed onto the target field 188, as indicated by the dashed outline 192 in FIG. 2. To the user, the illuminated dot 192 thus appears to be projected onto the target field 188, even though it is actually being projected toward the user's second eye from the OEG 100 and nothing is being physically projected onto the target field 188. As with other sights, the user aligns the weapon such that illuminated dot 192 is disposed directly on the desired point of impact. If the OEG 100 is accurately aligned with the bore of the barrel of the gun, the point of impact may be accurately conveyed to the user by the apparent position of the illuminated dot 192 on the target field 188.

The OEG 100 includes a light source that provides light to an optical device (e.g., a reflector, a lens, and/or one or more other appropriate optical members). The optical device may pass the light to the user (e.g., by reflection, refraction, and/or one or more other appropriate optical techniques) as a beam of collimated light which appears to the user as the illuminated dot 192.

Figure 3:
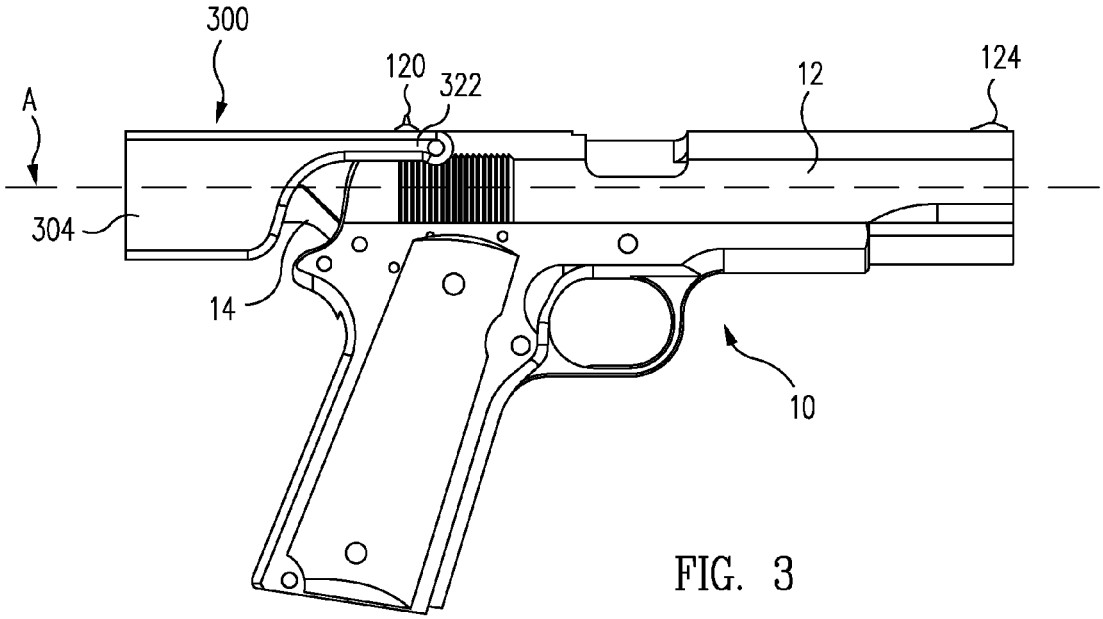
FIGS. 3-4 illustrate various mountings of a gun sight on a pistol in accordance with embodiments of the invention.
Figure 4:
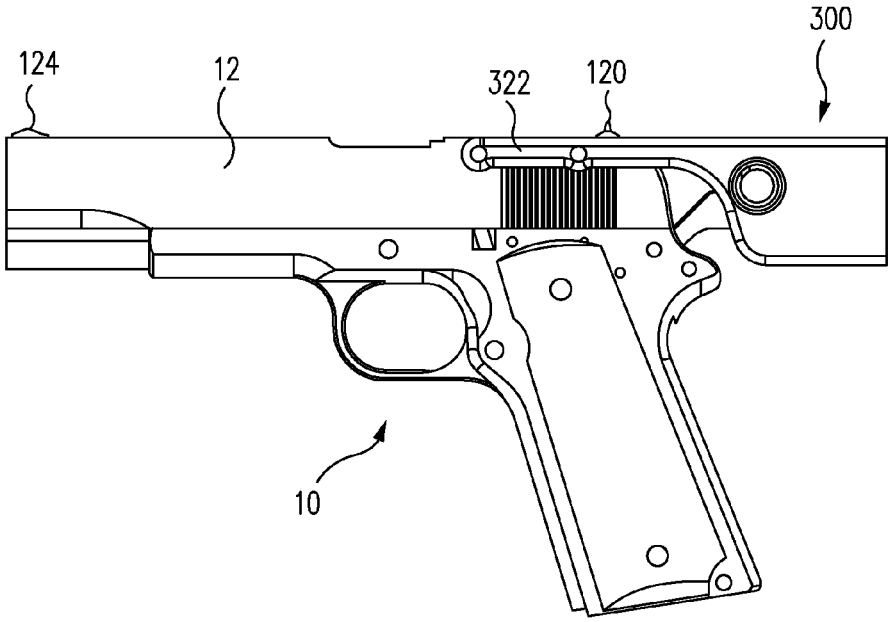
Figure 5:
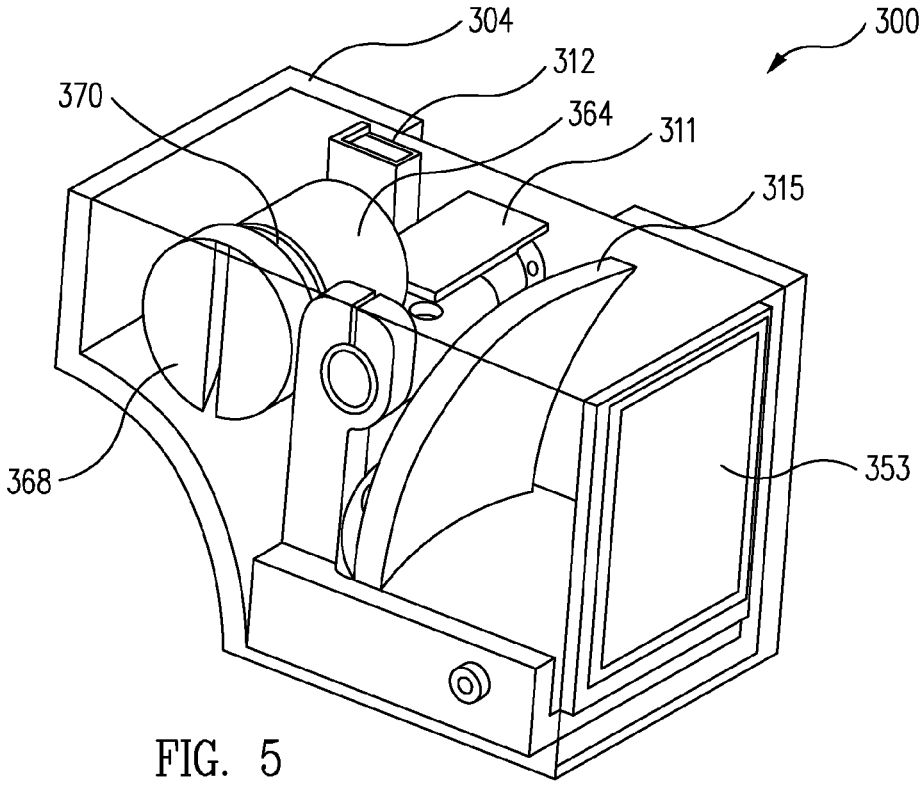
FIGS. 5-16 illustrate various implementations of a gun sight employing a reflective optical implementation in accordance with embodiments of the invention.
Figure 6:
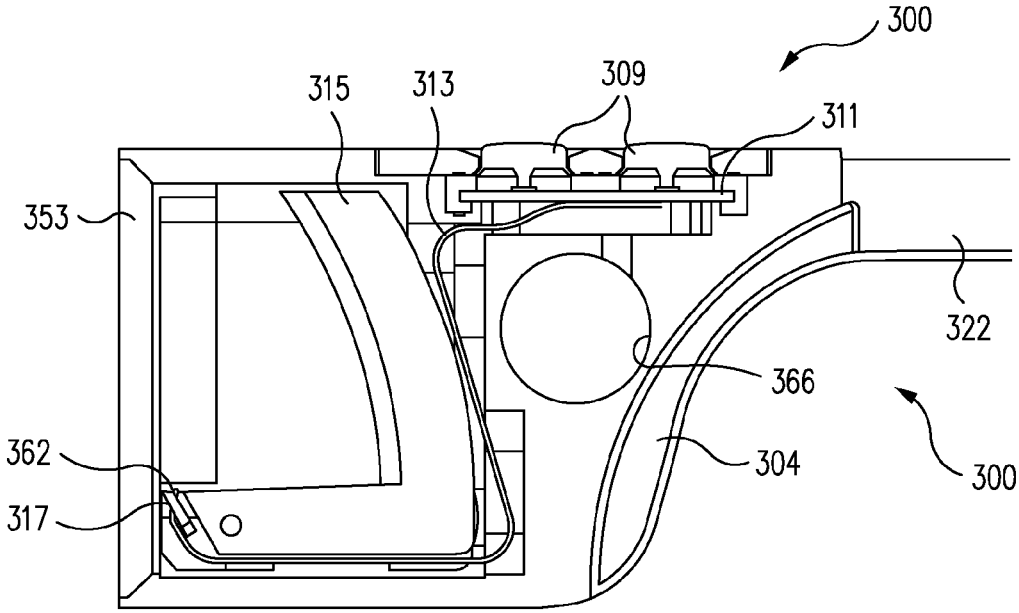
Figure 7:
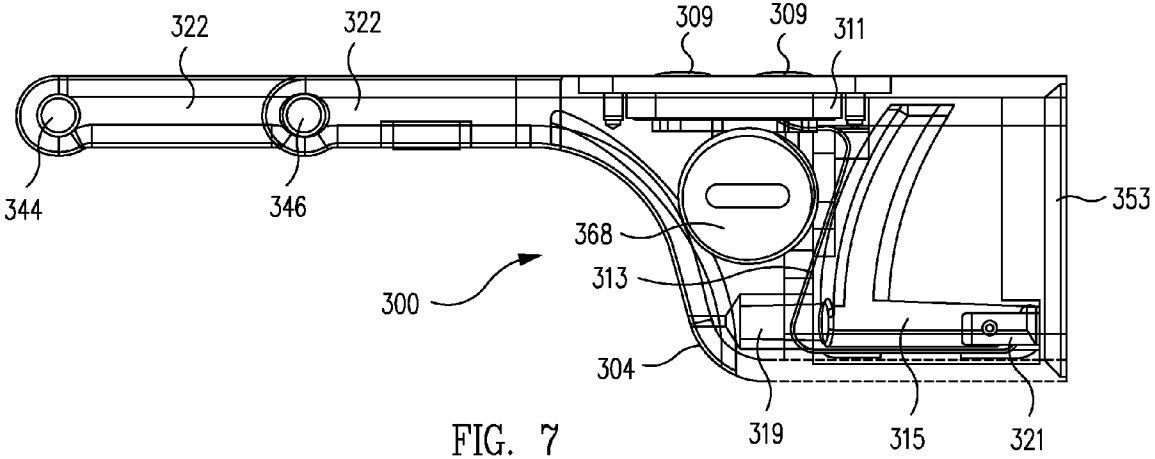

Referring to FIGS. 3-4, an embodiment of the invention is shown as it might be used on a typical 1911 pistol 10. The sight 300 is contained in a housing 304 that is attached to the slide 12 and it is positioned directly behind the firing mechanism such as the hammer 14 such that the sight 300 is aligned substantially co-axially with the longitudinal axis A of the barrel of the pistol 10 so that the illuminated dot 192 is generally centered on the central axis of the barrel. This mounting position minimizes any impact on the balance of the weapon and gives the user the impression of seeing "through" the pistol as their dominant eye is aligned with the longitudinal axis A of the barrel of the pistol. The sight 300 is also aligned consistent with the pistol's front and rear sights 120 and 124 that sit on the top of the slide 12, and is positioned so that it does not interfere with the use of the iron sights. This allows the user to have access to both the sight 300 and the front and rear sights 120 and 124, or any other sighting devices mounted on the top or side of the weapon, while requiring only a slight adjustment in shooting position and mechanics to switch between the various sighting options.

In an exemplary embodiment, the illuminated dot 192 seen by the user is created by an illuminated dot generator or plane wave generator disposed within the housing 304. The illuminated dot generator comprises a light source and some form of optical device, typically a collimating optical device, to produce a plane wave of light that appears to the user as an illuminated dot focused at infinity. In one embodiment, the illuminated dot generator must be mounted within the housing 304 to establish the nominal alignment of the illuminated dot 192 within the sight 300. The housing 304 is then mounted to the firearm 10 and may be pre-aligned at the factory for a standard range (typically 25 yards using standard ammunition) or its alignment may be user adjustable for range (up and down) and/or windage (side-to-side).

The illuminated dot generator may use a wide variety of mechanisms to generate the illuminated dot 192, including both refractive and reflective systems designed to create the desired collimated beam of light. In a reflective system, the light source projects light away from the user's eye. This light is then reflected back toward the user by a reflective surface such as a parabolic reflective mirror. In a refractive system, the light source typically projects light directly back toward the user's eye. This light is then shaped by a refractive optic, typically some type of lens.

An embodiment of a reflective sight 300 in accordance with an embodiment of the invention is illustrated in FIGS. 5-16. In this embodiment, the illuminated dot generator incorporates a parabolic mirror 315 that reflects light from a point light source 362 toward the rectangular aperture 353 of the sight 300 as a collimated beam of light. The aperture 353 is a transparent, planar, rectangular "window" through which the illuminated dot 192 is seen by the user. In one embodiment, the window 353 may be coated with an optical filter that passes only light of one or more selected wavelength(s).

Light source 362 is powered by a small battery 364, such as a ⅓ N cell lithium or NiCad battery, contained in a cylindrical battery compartment 366 in the housing 304 and held therein by a small, threaded battery door 368 and a compression spring 370.

The housing 304 of the sight 300 includes a pair of parallel, forwardly extending mounting ears 322, one of which, viz., the right ear 322, may be shorter than the other, or vice versa. In another embodiment, the ears 322 may be approximately equal in length. The forward pin 344 establishes two fixed positions on the slide of the firearm while the rearward pin 346 fixes the position of the housing rotationally. Removal of the rearward pin 346 allows the housing 304 to be rotated upward and removed from the slide for gun cleaning.

This embodiment may include a pair of light source 362 push button control switches 309 (e.g., up and down buttons in one embodiment). Selectively depressing one or both of the switches 309 may, for example, increase or decrease the brightness (e.g., intensity) of the light source 362 of the sight 300, turn the light source on or off, serve to program an on-off timer incorporated in appropriate control circuitry of the sight 300, and/or perform other operations as may be desired in various embodiments. In one embodiment, the pushbuttons 309 may be mounted on a printed circuit board (PCB) 311 and interconnected to the light source 362 via a thin, flat, flexible cable 313, as illustrated in, e.g., FIG. 6. The pushbuttons would signal the control unit on the PCB 311 to increase or decrease the brightness of the illuminated dot 192. The sight 300 may also include a potentiometer 312 that may be used to adjust the brightness of light provided by the light source 362 which permits adjustment of the brightness of the illuminated dot 192.

Figure 38A:
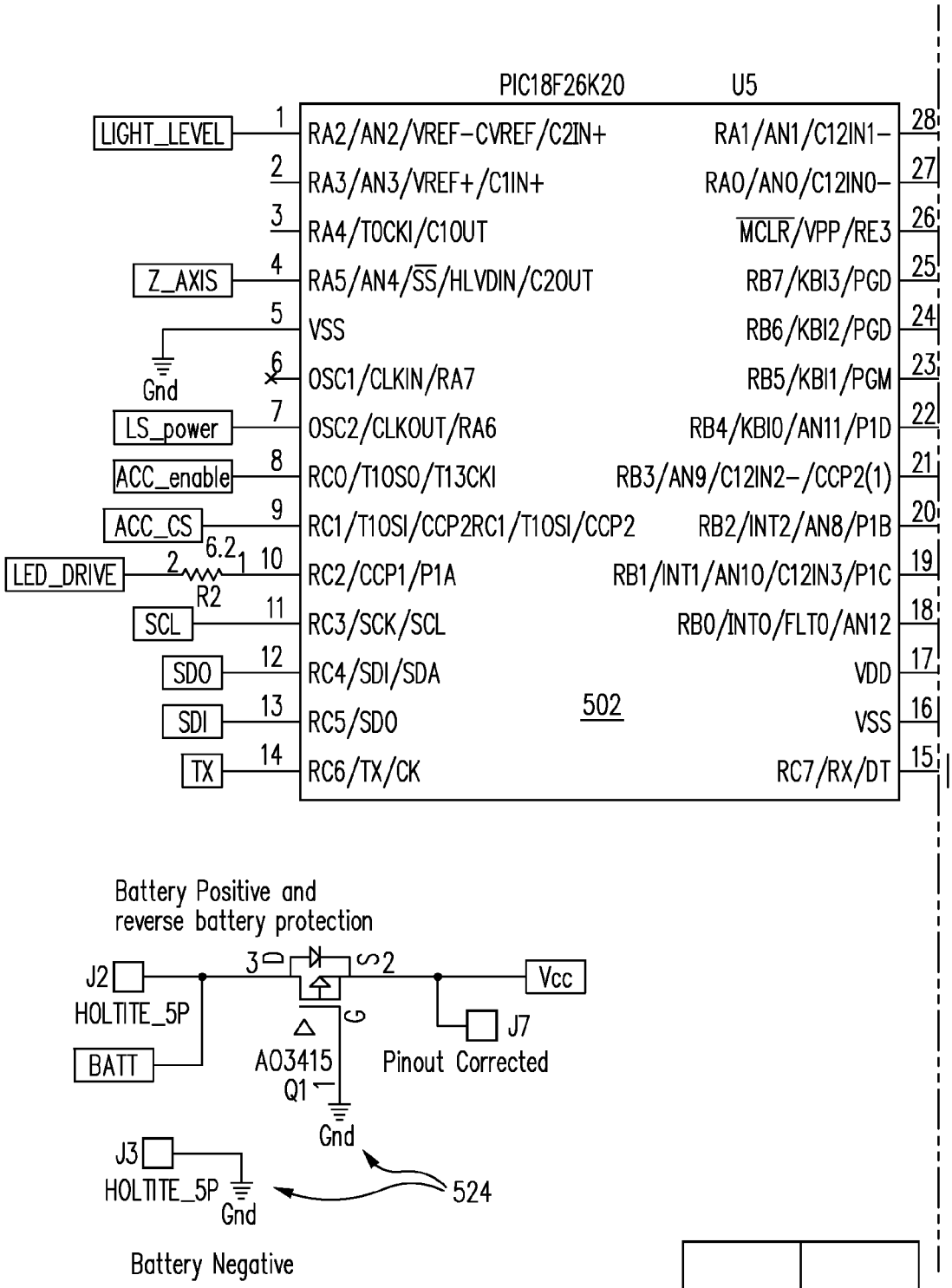
FIGS. 38-39 illustrate various circuit components which may be provided as part of a gun sight in accordance with embodiments of the invention.
Figure 38B:
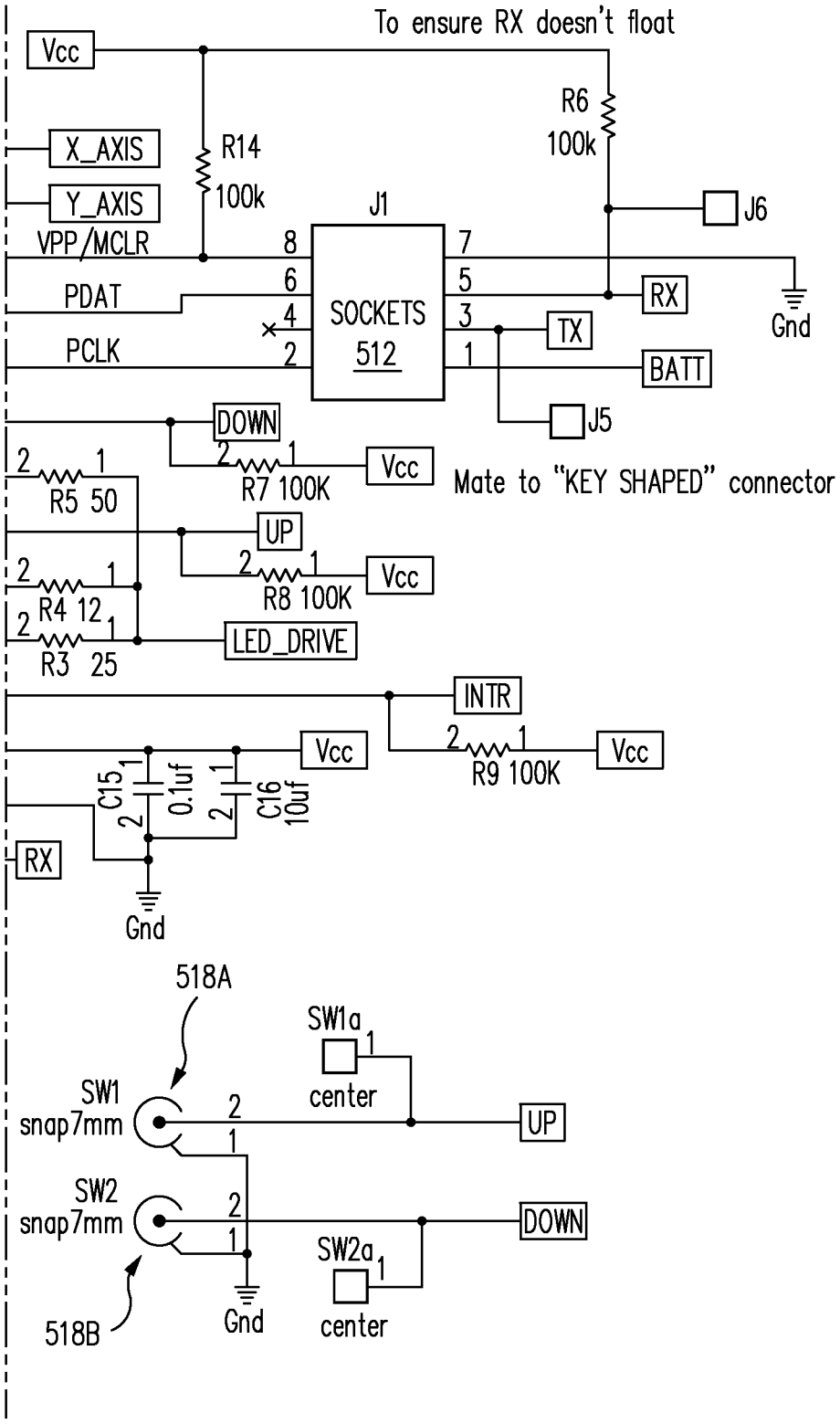
Figure 39A:
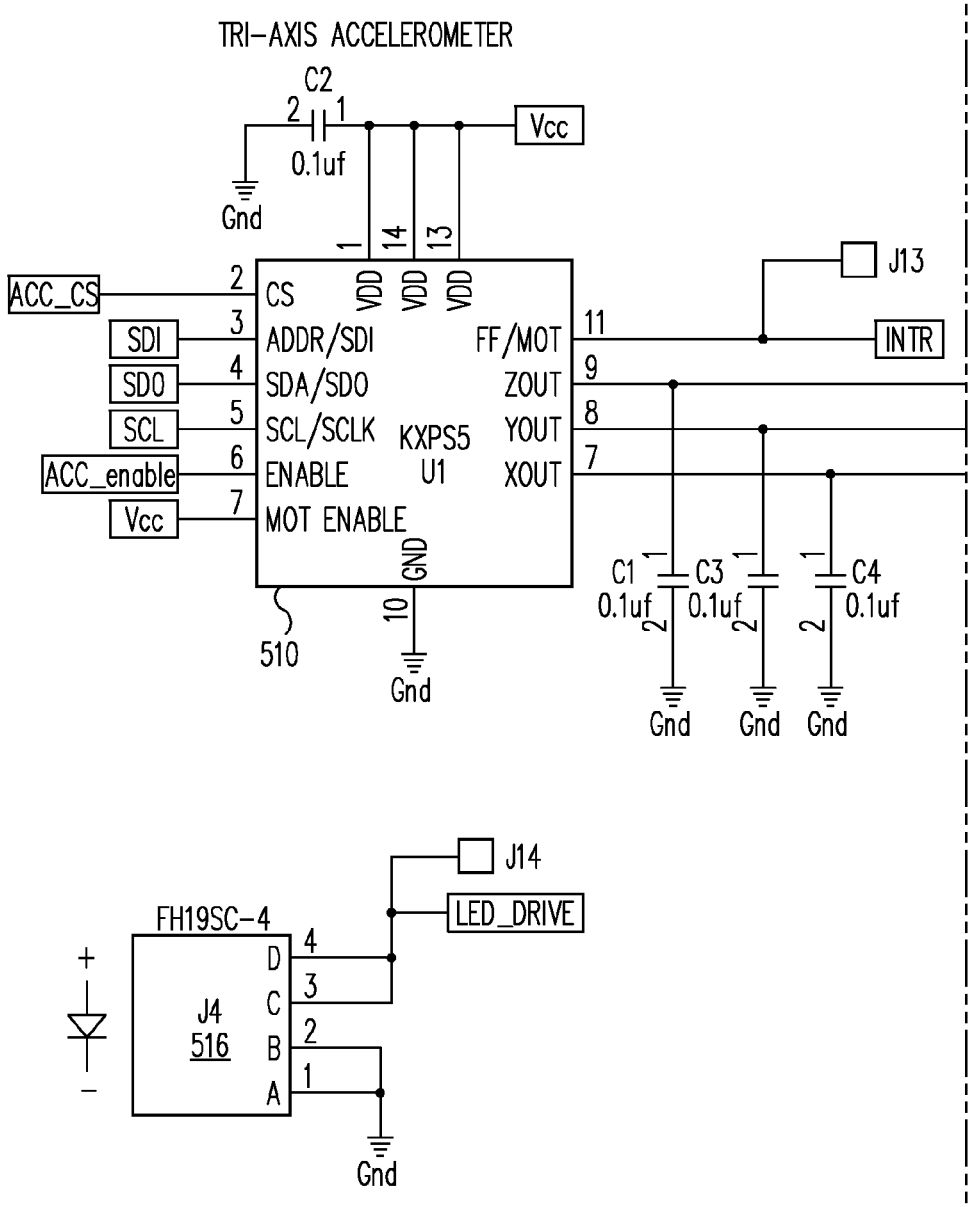
Figure 39B:
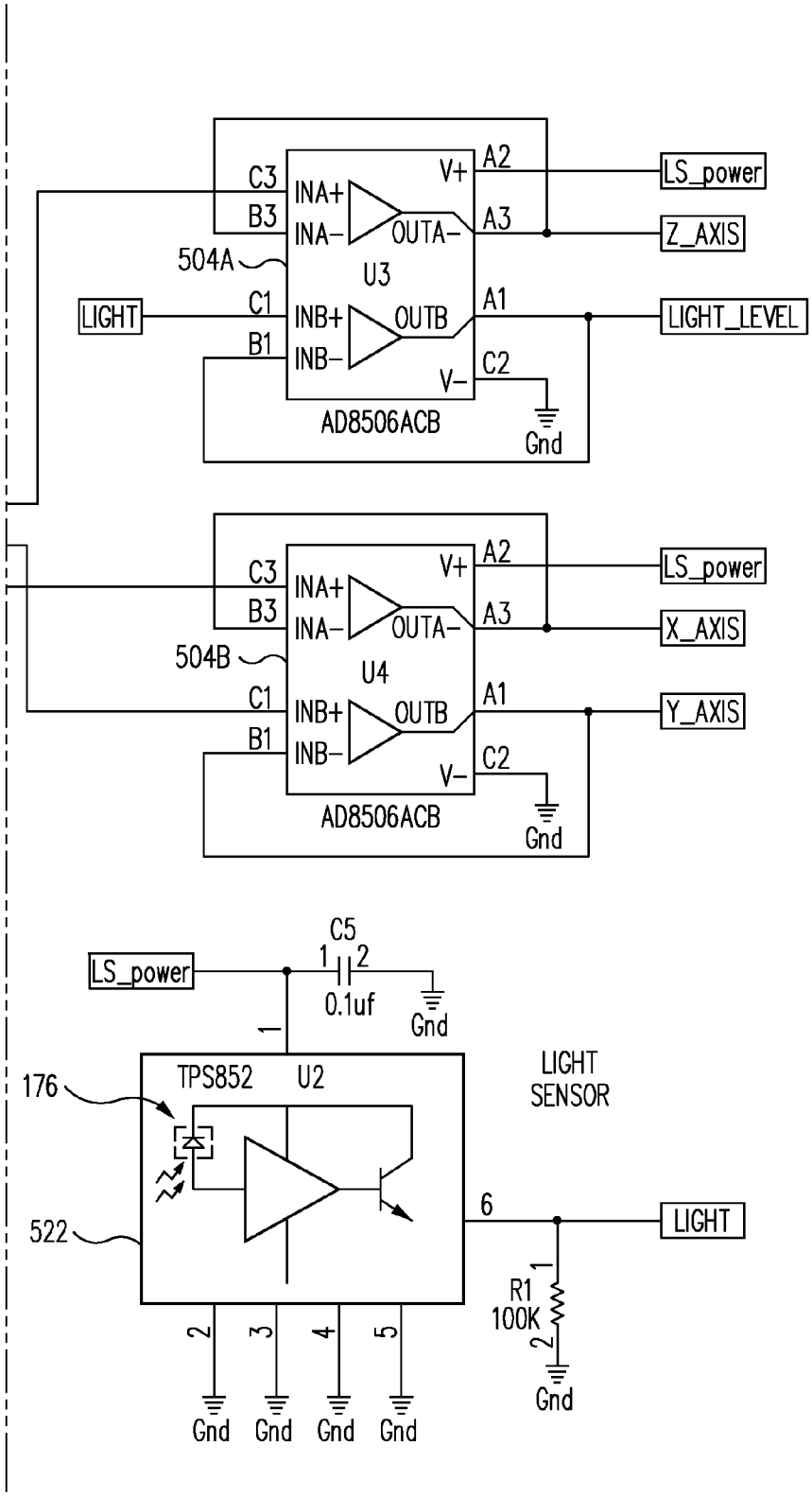

In one embodiment, PCB 311 may be used to provide one or more of various circuit components illustrated in FIGS. 38-39. The various components of FIGS. 38-39 may be used with any of the PCBs of any of the gun sights disclosed herein. Referring now to FIGS. 38-39, PCB 311 may include a microcontroller 502 (e.g., also referred to as "uC" which may be a PIC18F26K20 microcontroller available from Microchip Technology Inc. of Chandler, Ariz. in one embodiment), operational amplifiers 504A-B (e.g., 8506ACB operational amplifiers available from Analog Devices, Inc. of Norwood, Mass. in one embodiment), an accelerometer 510 (e.g., a KXPS5 series tri-axis accelerometer such as any of model numbers KXPS5-1050, KXPS5-2050, KXPS5-3157, KXPS5-4457, or others available from Kionix, Inc. of Ithaca, N.Y. in one embodiment), a socket 512 (e.g., to permit testing and programming of microcontroller 502 while PCB 311 is installed in a gun sight in one embodiment), a connector 516 (e.g., a FH19SC-4 socket available from Hirose Electric USA, Inc. of Simi Valley, Calif. to connect to cable 313 in one embodiment), switch contacts 518A-B (e.g., 7 mm spring snap contacts in one embodiment) for switches 309, an ambient light sensor 522 (e.g., which may include photodiode 176 and may be a TPS852 illumination sensor available from Toshiba America Electronic Components, Inc. of Irvine, Calif. in one embodiment), a battery connection and protection circuit 524, and various other components as shown.

It will be appreciated that various components of FIGS. 38-39 may be interconnected with each other through circuit connections (e.g., through pins, circuit board traces, or otherwise) labeled with various signals as shown. In one embodiment, the various pins of microcontroller 502 may be used in the manner set forth in the following Table 1:

TABLE 1 pins of microcontroller 502

| Pin | Signal/Connection Name (type) | Operation |
|---|---|---|
| 1 | LIGHT_LEVEL (analog) | Analog light level from ambient light sensor; digitized by microcontroller's A/D converter and used to adjust LED intensity for proper viewing |
| 2 | not connected | not connected |
| 3 | not connected | not connected |
| 4 | Z_AXIS (analog) | Z-Axis accelerometer signal; digitized by microcontroller's A/D converter and used for hammer fall detection; intelligent power control may be provided by selectively powering LED and/or other components in response to detection that gun sight is in use (e.g., a shooting mode) |
| 5 | Gnd (power) | System ground; power return path (1 of 2) |
| 6 | not connected | not connected |
| 7 | LS_power (power) | Power supply to ambient light sensor; light sensor may be powered down when not necessary for battery longevity when gun sight is not in use (e.g., not in a shooting mode) |
| 8 | ACC_enable (digital) | Communications enable for accelerometer; normally low, pulled high during serial communications with accelerometer via Serial Peripheral Interface (SPI) |
| 9 | ACC_CS (digital) | Chip select for accelerometer; may be used for accelerometer operation; low starts data acquisition/conversion; stays low until SPI data transfer from current conversion is completed |
| 10 | LED_DRIVE (digital/power) | Drive signal to illuminate LED; pulse width modulation (PWM) signal; PWM duty cycle controls LED's intensity (1 of 4); 4 outputs provide current to LED (e.g., each output may be limited to 25 mA maximum in one embodiment) |
| 11 | SCL (digital) | SPI clock; clock signal for SPI communications with accelerometer |
| 12 | SDO (digital) | SPI data out; data output signal for SPI communications with accelerometer |
| 13 | SDI (digital) | SPI data in; data input signal for SPI communications with accelerometer |
| 14 | TX (digital) | RS-232 data output; RS-232 data path used for system development/troubleshooting |

TABLE 1-continued

| pins of microcontroller 502 | | |
|---|---|---|
| Pin | Signal/Connection Name (type) | Operation |
| 15 | RX (digital) | RS-232 data input; RS-232 data path used for system development/troubleshooting |
| 16 | Gnd (power) | System ground; power return path (2 of 2) |
| 17 | Vcc (power) | System power; from battery; after reverse polarity protection field effect transistor (FET) |
| 18 | INTR (digital) | Interrupt from accelerometer; programmable interrupt from accelerometer; used to wake up sleeping systems in event of large acceleration as part of intelligent power control |
| 19 | LED_DRIVE (digital/power) | Drive signal to illuminate LED; PWM LED drive signal (2 of 4); see pin 10 |
| 20 | LED_DRIVE (digital/power) | Drive signal to illuminate LED; PWM LED drive signal (3 of 4); see pin 10 |
| 21 | UP (digital) | Signal from up button; normally high; low indicates that up button is depressed |
| 22 | LED_DRIVE (digital/power) | Drive signal to illuminate LED; PWM LED drive signal (4 of 4); see pin 10 |
| 23 | DOWN (digital) | Signal from down button; normally high; low indicates that down button is depressed |
| 24 | PCLK (digital) | Programming clock; clock signal for uploading program into microcontroller |
| 25 | PDAT (digital) | Programming data; data signal for uploading program into microcontroller |
| 26 | VPP/MCLR (power) | Programming voltage supply; pulled to programming voltage (Vpp) by external hardware to program microcontroller; held at Vcc for normal operation |
| 27 | Y_AXIS (analog) | Y-Axis accelerometer signal; digitized by microcontroller's A/D converter; see pin 3 |
| 28 | X_AXIS (analog) | X-Axis accelerometer signal; digitized by microcontroller's A/D converter; see pin 3 |

In one embodiment, microcontroller 502 may be configured with appropriate instructions (e.g., software instructions) to provide intelligent power control features for a gun sight. For example, microcontroller 502 may be used to detect weapon orientation and motion in response to various input signals such as, for example, signals received from accelerometer 510. Such detected information may be used by instructions running in microcontroller 502 to identify a current intended use of the weapon (e.g., to identify whether or not a user is ready to fire the weapon). In response to this identified intended use, microcontroller 502 may selectively provide (e.g., supply, limit, and/or interrupt) power to any desired electronic components of the gun sight.

For example, if microcontroller 502 identifies that a user is ready to fire the weapon, then microcontroller 502 may supply power to appropriate electronic components of the gun sight to operate the gun sight in a firing mode (e.g., in live fire or dry fire modes). As another example, if microcontroller 502 identifies that a user is not ready to fire the weapon (e.g., the weapon may be holstered or otherwise not in a firing position), then microcontroller 502 may limit and/or interrupt power to appropriate electronic components of the gun sight to conserve power (e.g., to peinlit longer battery life to be realized).

In one embodiment, the various pins of accelerometer 510 may be used in the manner set forth in the following Table 2:

TABLE 2

| pins of accelerometer 510 | | |
|---|---|---|
| Pin | Signal/Connection Name (type) | Operation |
| 1 | Vcc (power) | System power; from battery; after reverse polarity protection FET (1 of 3) |
| 2 | ACC_CS (digital) | Chip select; may be used for accelerometer operation; low starts data acquisition/conversion; stays low until SPI data transfer from current conversion is completed |
| 3 | SDI (digital) | SPI data in; data input signal for SPI communications with microcontroller |
| 4 | SDO (digital) | SPI data out; data output signal for SPI communications with microcontroller |
| 5 | SCL (digital) | SPI clock; clock signal for SPI communications with microcontroller |
| 6 | ACC_Enable (digital) | Communications enable; high from microcontroller permits accelerometer to communicate via SPI |
| 7 | XOUT (analog) | Accelerometer X axis signal; buffered by op-amp and presented to microcontroller's A/D converter |
| 8 | YOUT (analog) | Accelerometer Y axis signal; buffered by op-amp and presented to microcontroller's A/D converter |
| 9 | ZOUT (analog) | Accelerometer Z axis signal; buffered by op-amp and presented to microcontroller's A/D converter |
| 10 | Gnd (power) | System ground; power return path |
| 11 | INTR (digital) | Accelerometer interrupt; Programmable interrupt; goes high if programmed acceleration value is exceeded in one embodiment; may be used by microcontroller to wake from sleep mode to support intelligent power control |
| 12 | MOT ENABLE (digital) | Interrupt enable; pulled high (Vcc) to allow generation of interrupt signal (see pin 11) |
| 13 | Vcc (power) | System power; from battery; after reverse polarity protection FET (2 of 3) |
| 14 | Vcc (power) | System power; from battery, after reverse polarity protection PET (3 of 3) |

In one embodiment, the various pins of ambient light sensor 522 may be used in the manner set forth in the following Table 3:

TABLE 3

| pins of ambient light sensor 522 | | |
|---|---|---|
| Pin | Signal/Connection Name (type) | Operation |
| 1 | LS_power (power) | Light sensor power; may be supplied by microcontroller output; low/off saves power for intelligent power control; high/on allows operation |
| 2 | Gnd (power) | Ground; power return path |
| 3 | Gnd (power) | Ground; power return path |
| 4 | Gnd (power) | Ground; power return path |
| 5 | Gnd (power) | Ground; power return path |
| 6 | LIGHT (analog) | Analog output; voltage may be a function of detected ambient light in one embodiment |

In one embodiment, the various pins of operational amplifier 504A may be used in the manner set forth in the following Table 4:

TABLE 4

| pins of operational amplifier 504A | | |
|---|---|---|
| Pin | Signal/Connection Name (type) | Operation |
| A2 | LS_power (power) | Light sensor power; may be supplied by microcontroller output; low/off saves power for intelligent power control; high/on allows operation |
| C2 | Gnd (power) | Ground; power return path |
| C1 | LIGHT (analog) | Analog light level from ambient light sensor; voltage may be a function of detected ambient light in one embodiment |
| B1, A1 | LIGHT_LEVEL (analog) | Buffered light level; sent to microcontroller's A/D converter for digitization |
| C3 | ZOUT (analog) | Z axis signal from accelerometer; amplitude may be a function of Z axis measured acceleration in one embodiment |
| B3, A3 | Z_AXIS (analog) | Buffered Z axis level; sent to microcontroller's A/D converter for digitization |

In one embodiment, the various pins of operational amplifier 504B may be used in the manner set forth in the following Table 5:

TABLE 5

| pins of operational amplifier 504B | | |
|---|---|---|
| Pin | Signal/Connection Name (type) | Operation |
| A2 | LS_power (power) | Light sensor power; light sensor may be powered down (e.g., when not needed) for battery longevity in response to detection that gun sight is not in use (e.g., not in a shooting mode) |
| C2 | Gnd (power) | Ground; power return path |
| C1 | YOUT (analog) | Y axis signal from accelerometer; amplitude may be a function of Y axis measured acceleration in one embodiment |
| B1, A1 | Y_AXIS (analog) | Buffered Y axis level; sent to microcontroller's A/D converter for digitization |
| C3 | XOUT (analog) | X axis signal from accelerometer; amplitude may be a function of X axis measured acceleration in one embodiment |
| B3, A3 | X_AXIS (analog) | Buffered X axis level; sent to microcontroller's A/D converter for digitization |

In one embodiment, the various pins of battery connection and protection circuit 524 may be used in the manner set forth in the following Table 6:

TABLE 6

| pins of battery connection and protection circuit 524 | | |
|---|---|---|
| Pin | Signal/Connection Name (type) | Operation |
| 1 | Gnd (power) | System ground; reference pin for backwards battery detection |
| 2 | Vcc (power) | System power; if pin 1 is negative relative to reference pin 3 (battery inserted backwards), FET turns off and no current flows in one embodiment; if pin 1 is positive relative to reference pin 3 (battery inserted correctly), FET turns on to provide power supply to system in one embodiment |
| 3 | BATT (power) | Battery positive; connected to positive battery terminal |
| J2 | BATT (power) | System power (prior to polarity protection); power supply from battery |
| J3 | Gnd (power) | System ground; main power return path to battery |

In one embodiment, the various pins of switch contact 518A may be used in the manner set forth in the following Table 7:

TABLE 7

| pins of switch contact 518A | | |
|---|---|---|
| Pin | Signal/Connection Name (type) | Operation |
| 1 | Gnd (digital) | System ground; power return path |
| 2 | UP (digital) | Up button pressed signal; pulled high internally by microcontroller; pulled to ground by up button press |

In one embodiment, the various pins of switch contact 518B may be used in the manner set forth in the following Table 8:

TABLE 8

| pins of switch contact 518B | | |
|---|---|---|
| Pin | Signal/Connection Name (type) | Operation |
| 1 | Gnd (digital) | System ground; power return path |
| 2 | DOWN (digital) | Down button pressed signal; pulled high internally by microcontroller; pulled to ground by down button press |

In one embodiment, the various pins of socket 512 may be used in the manner set forth in the following Table 9:

TABLE 9

| pins of socket 512 | | |
|---|---|---|
| Pin | Signal/Connection Name (type) | Operation |
| 1 | BATT (power) | Remote power to system (prior to polarity protection); provides power to system if battery is not installed; provided by external hardware through connector |
| 2 | PCLK (digital) | Programming clock; clock signal for uploading program into microcontroller; provided by external hardware through connector |
| 3 | TX (digital) | RS-232 data output; RS-232 data path used for system development/troubleshooting |
| 4 | not connected | not connected |
| 5 | RX (digital) | RS-232 data input; RS-232 data path used for system development/troubleshooting |
| 6 | PDAT (digital) | Programming data; data signal for uploading program into microcontroller; provided by external hardware through connector |
| 7 | Gnd (power) | System ground; power return path; provided by external hardware |
| 8 | VPP/MCLR (digital) | Programming voltage supply; pulled to programming voltage (Vpp) by external hardware to program microcontroller; held at Vcc by onboard resistor for normal operation |

In one embodiment, the various pins of connector 516 may be used in the manner set forth in the following Table 10:

TABLE 10

| pins of connector 516 | | |
|---|---|---|
| Pin | Signal/Connection Name (type) | Operation |
| 1 | Gnd (power) | System ground; power return path (1 of 2) |
| 2 | Gnd (power) | System ground; power return path (2 of 2) |
| 3 | LED_DRIVE (digital/power) | Drive signal to illuminate LED; PWM signal; PWM duty cycle controls LED's intensity (1 of 2) |
| 4 | LED_DR1VE (digital/power) | Drive signal to illuminate LED; PWM signal; see pin 3 (2 of 2) |

In one embodiment, test connections shown in FIGS. 38-39 and may be used in the manner set forth in the following Table 11:

TABLE 11

| test connections | | |
|---|---|---|
| Pin | Signal/Connection Name (type) | Operation |
| J5 | TX (digital) | RS-232 data output; RS-232 data path used for system development/troubleshooting |
| J6 | RX (digital) | RS-232 data input; RS-232 data path used for system development/troubleshooting |
| J7 | Vcc (power) | System power; power supply after reverse polarity protection FET |
| J13 | INTR (digital) | Accelerometer interrupt; programmable interrupt; goes high if programmed acceleration value is exceeded in one embodiment; may be used by microcontroller to wake from sleep mode to support intelligent power control |
| J14 | LED_DRIVE (digital/power) | PWM signal; PWM duty cycle controls LED's intensity |
| SW1a | UP (digital) | Up button pressed signal; pulled high internally by microcontroller; pulled to ground by up button press |
| SW2a | DOWN (digital) | Down button pressed signal; pulled high internally by microcontroller; pulled to ground by down button press |

Figure 8:
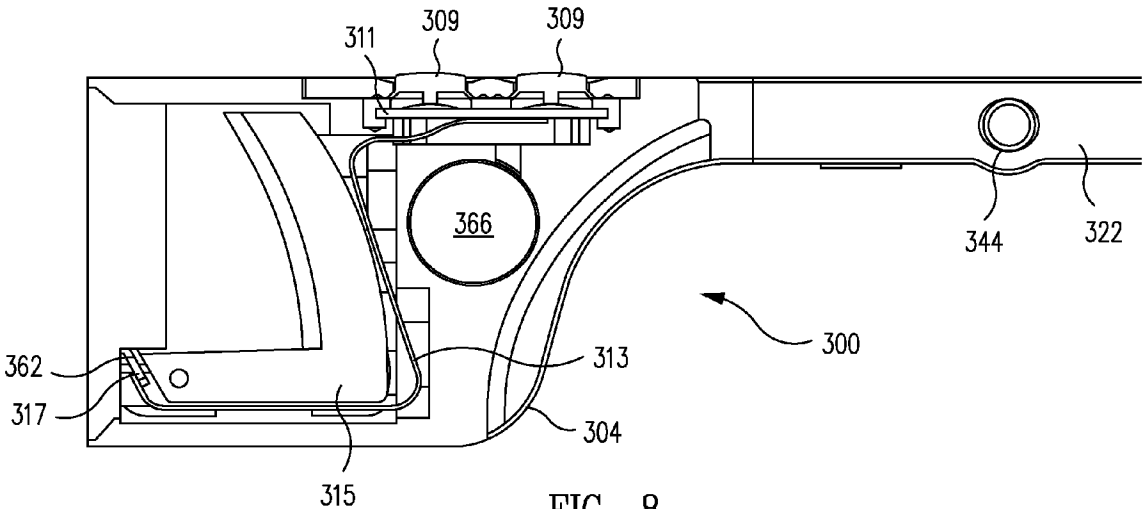
Figure 9:
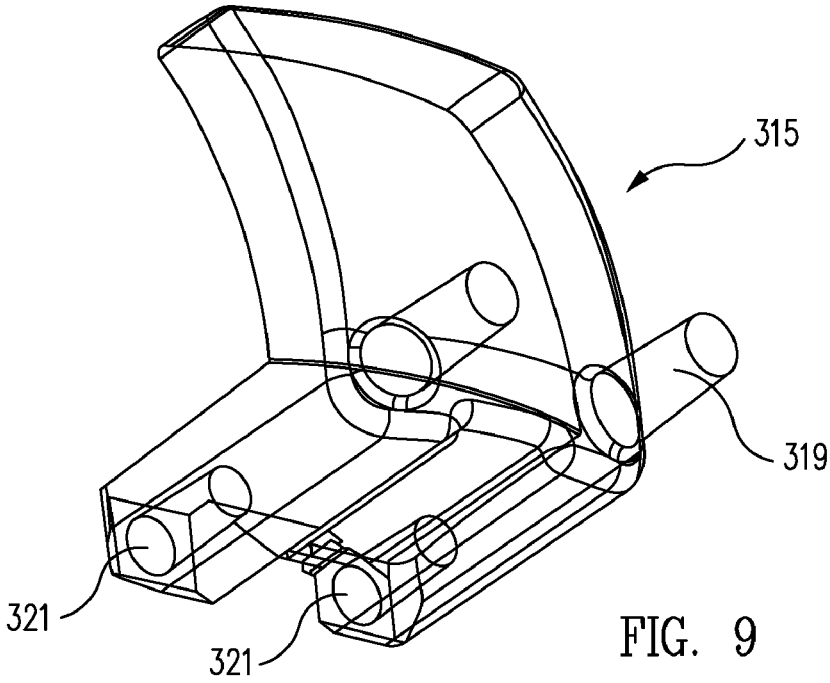
Figure 10:
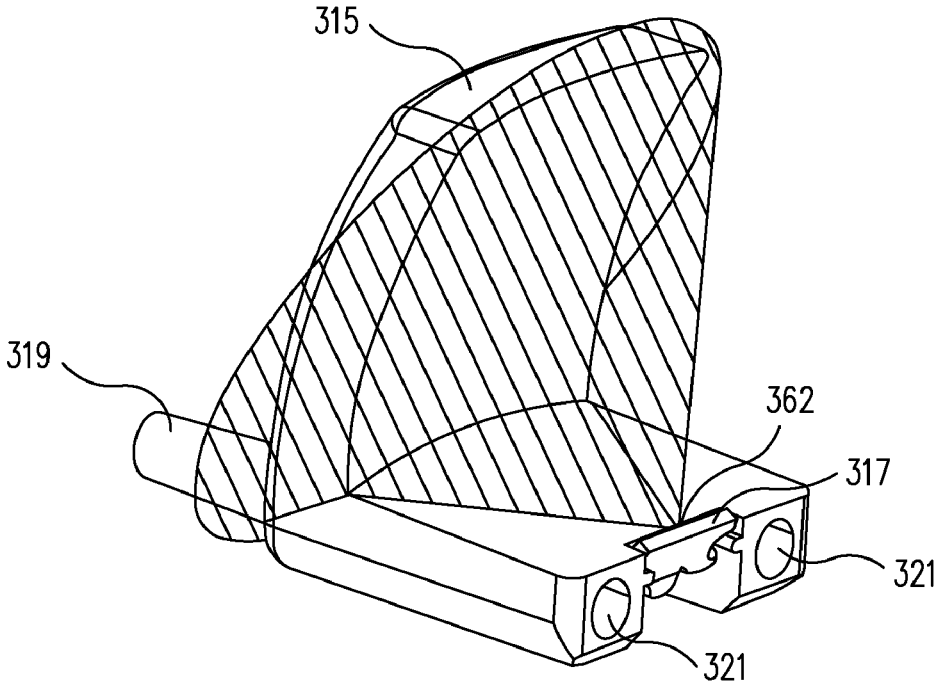
Figure 11:
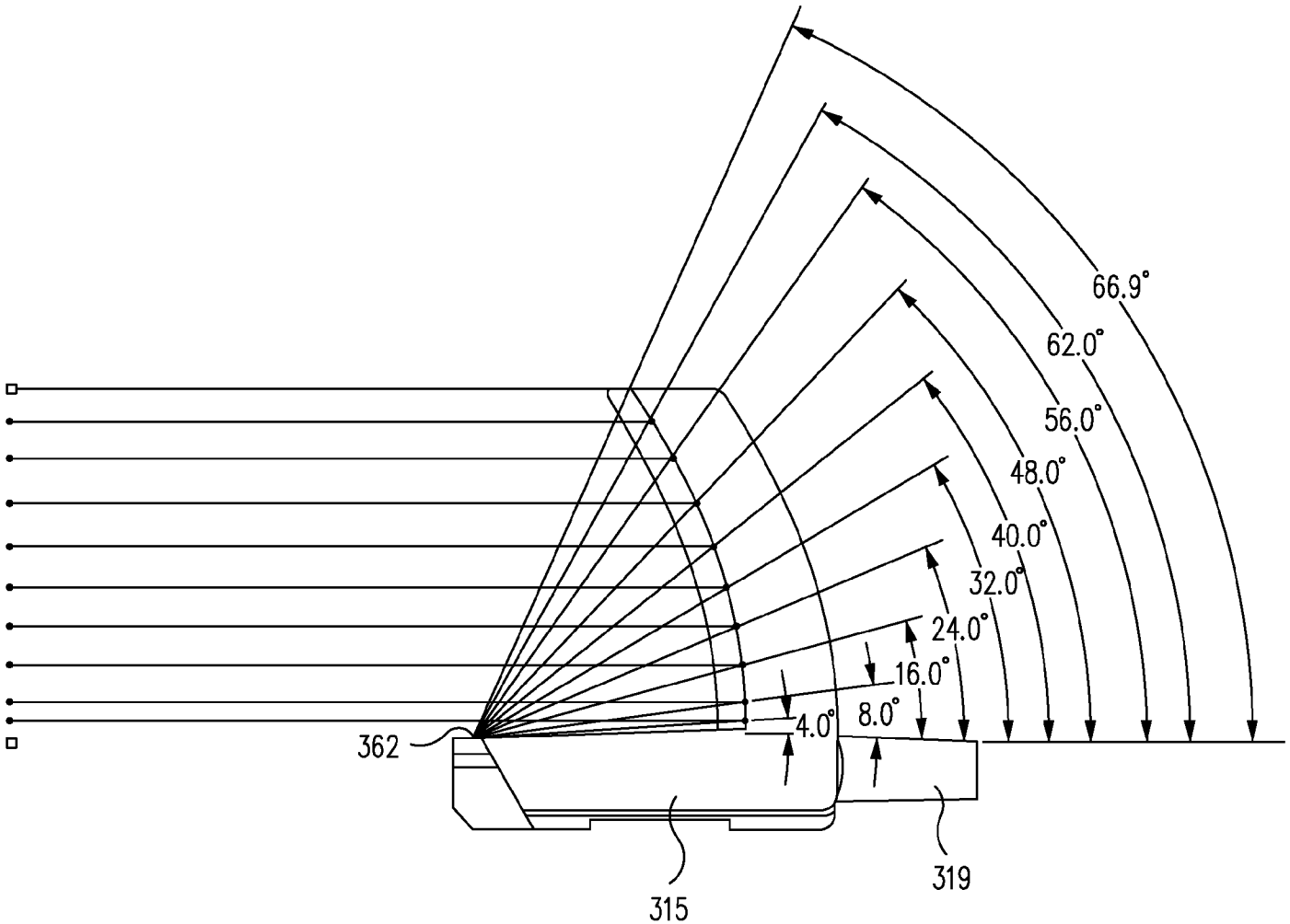
Figure 12:
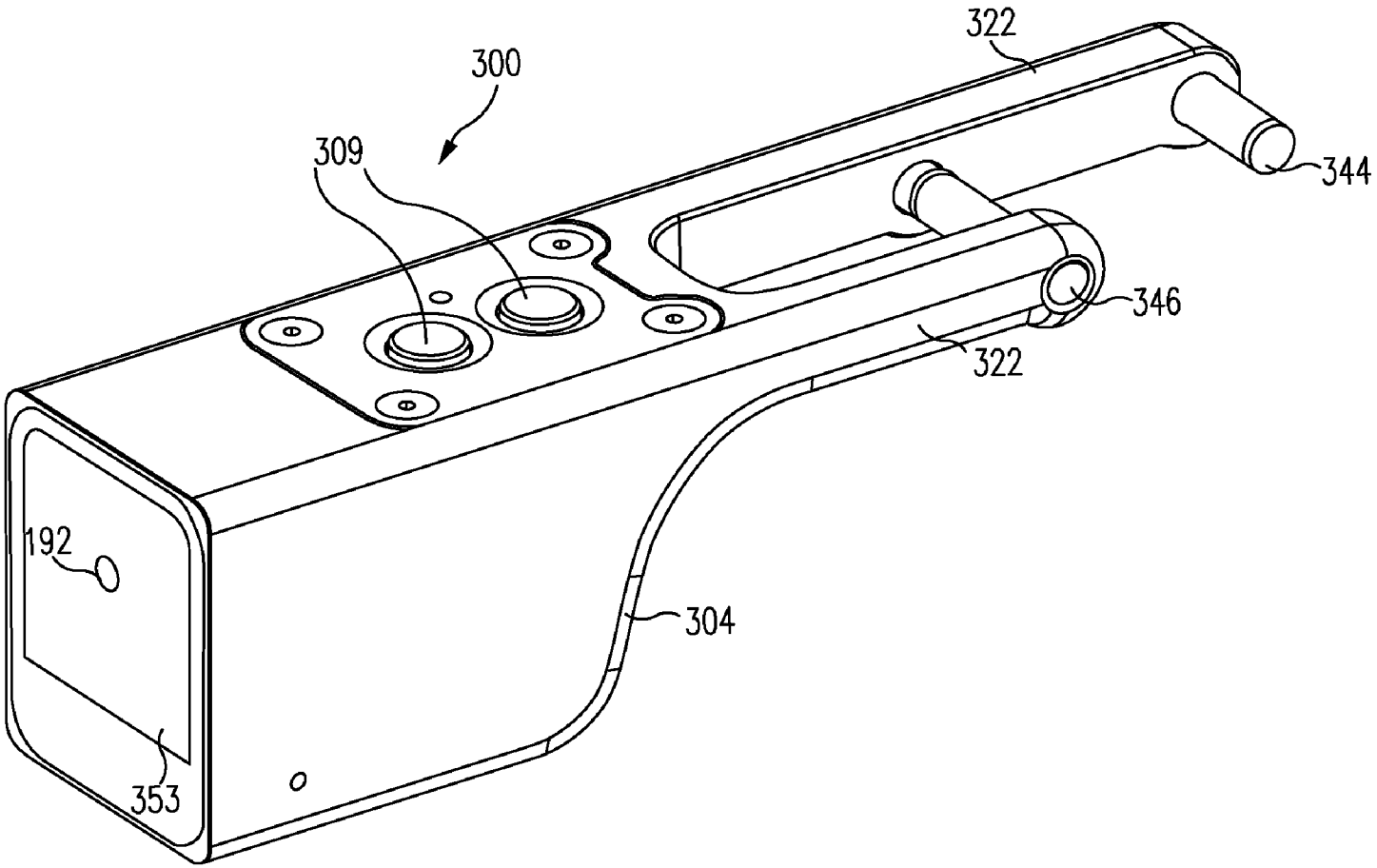
Figure 13:
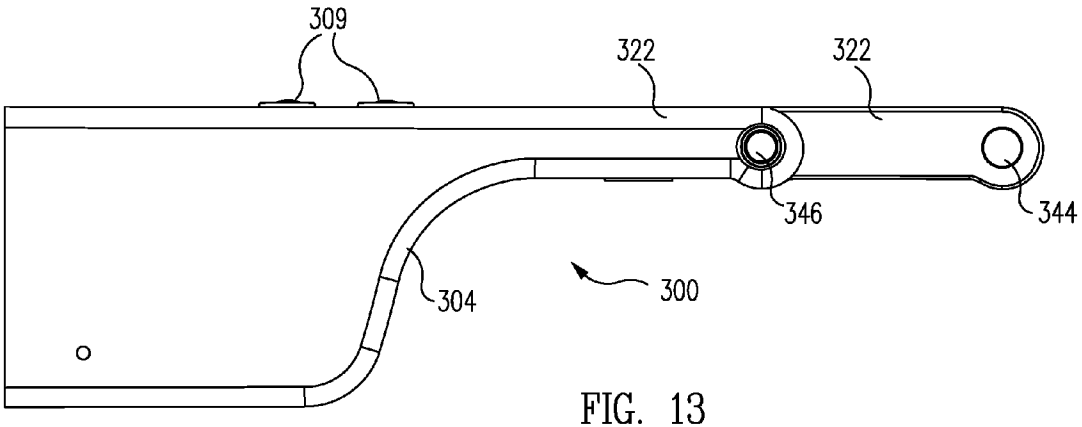
Figure 14:
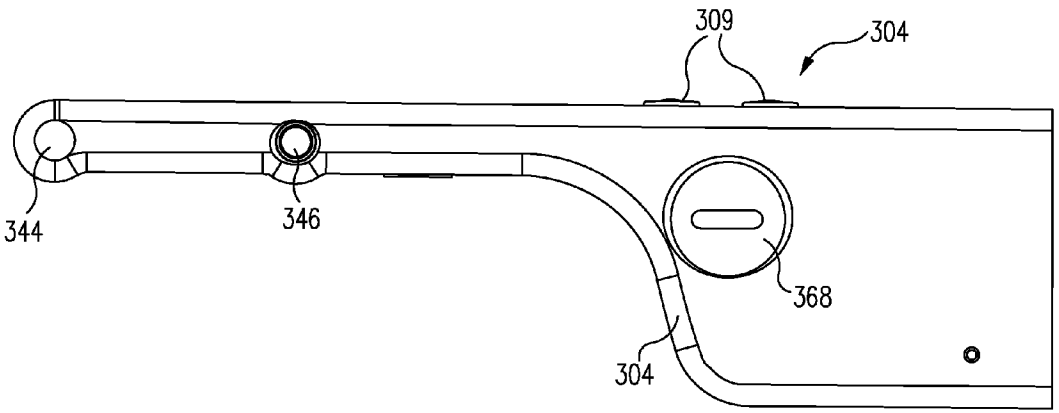
Figure 16:
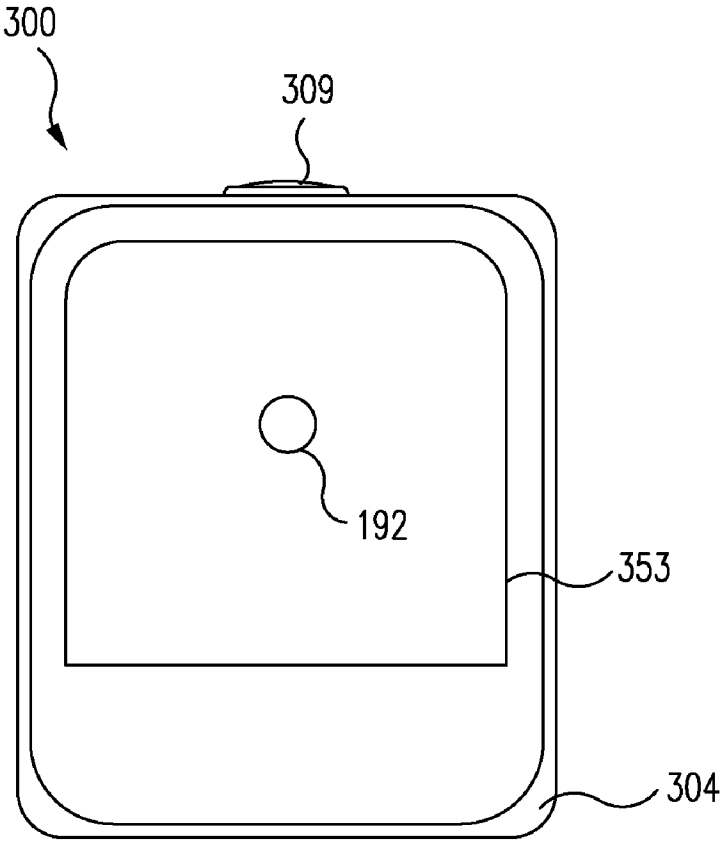
Figure 15:
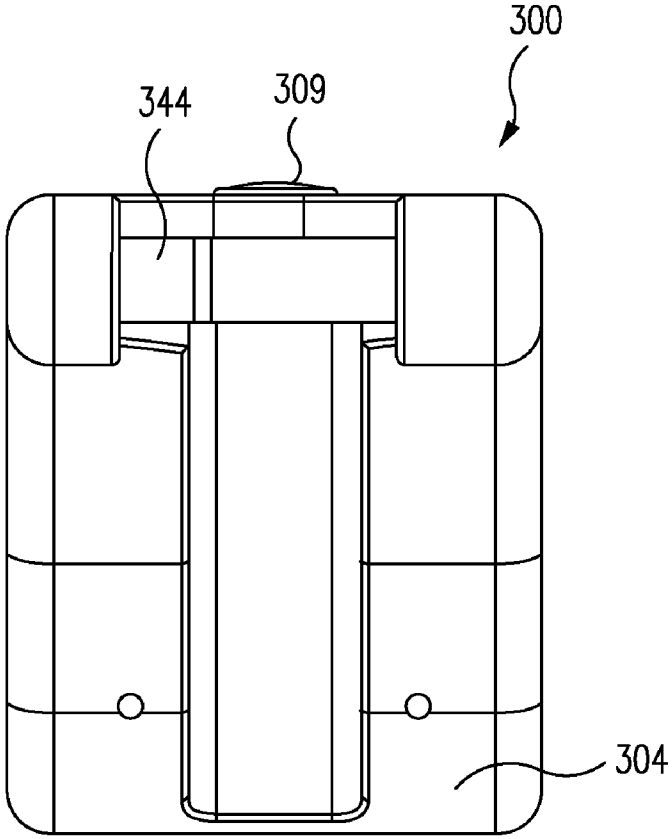
Figure 17:
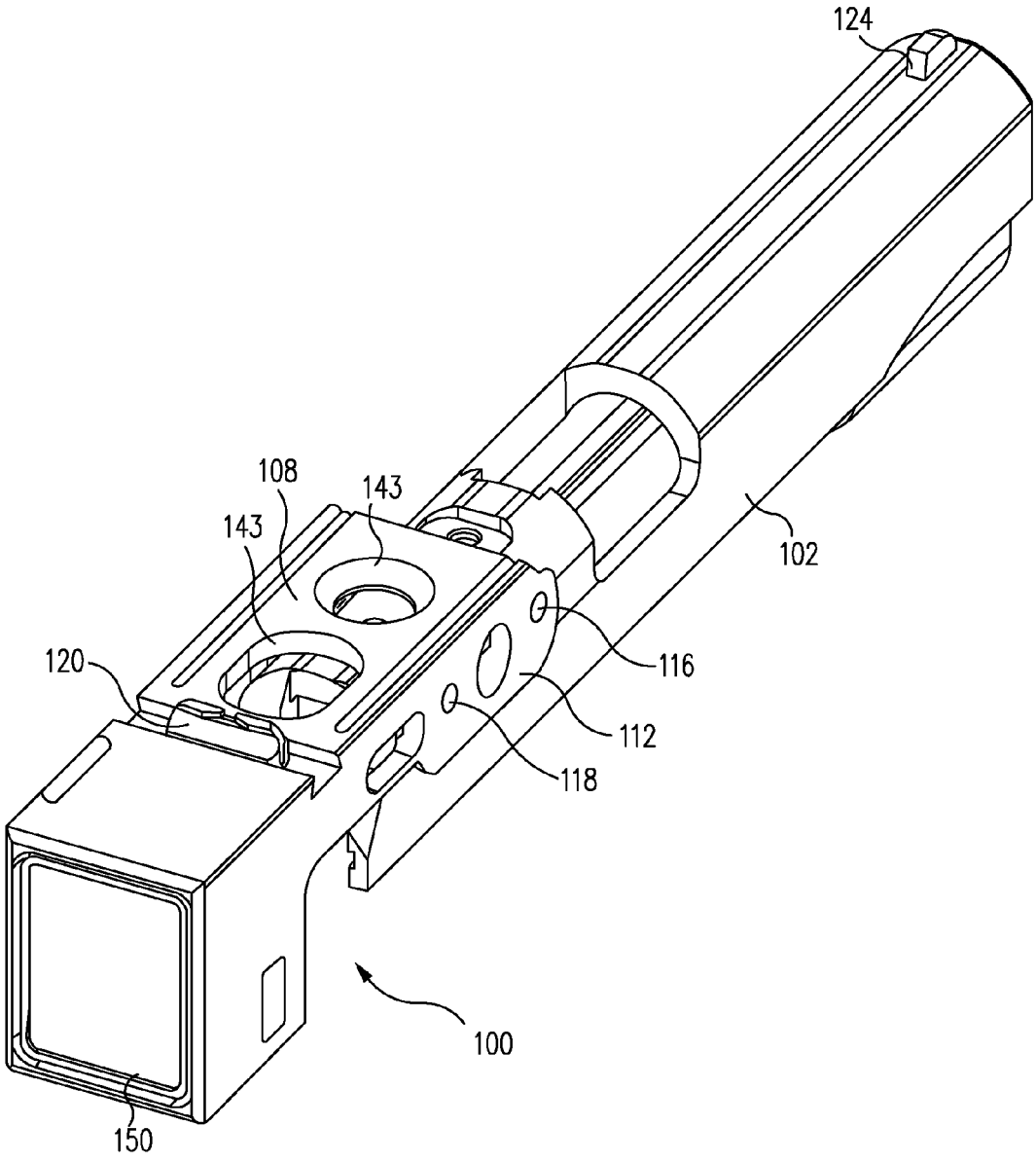
FIGS. 17-22 illustrate various implementations of a gun sight employing a refractive optical implementation in accordance with embodiments of the invention.
Figure 18:
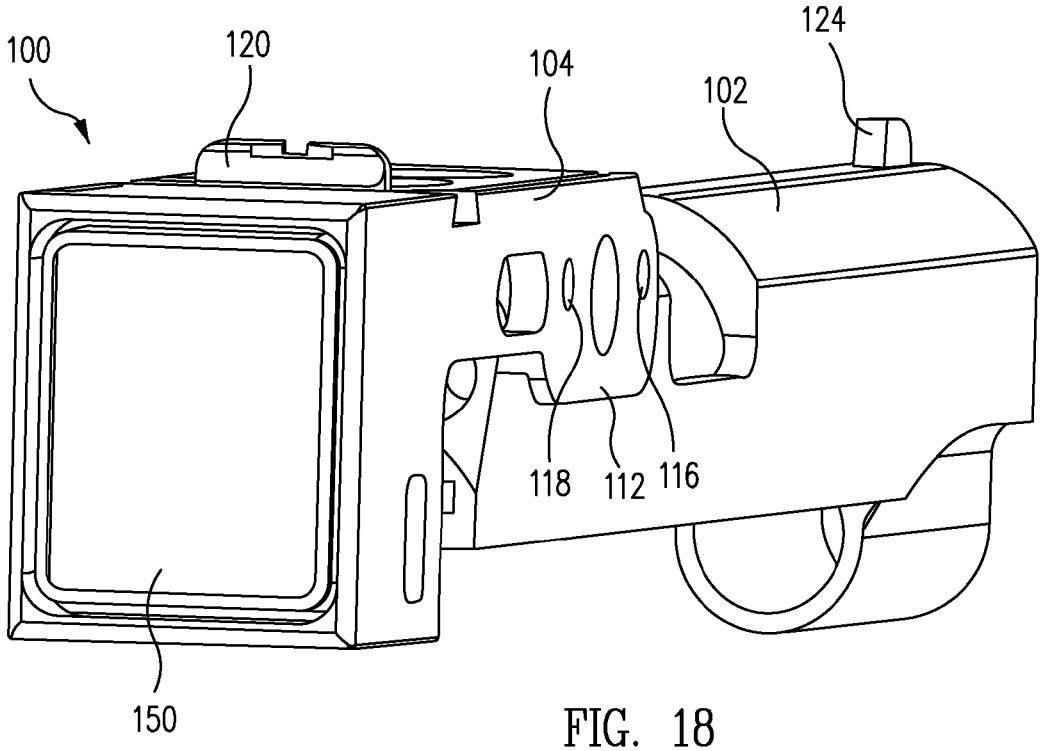
Figure 19:
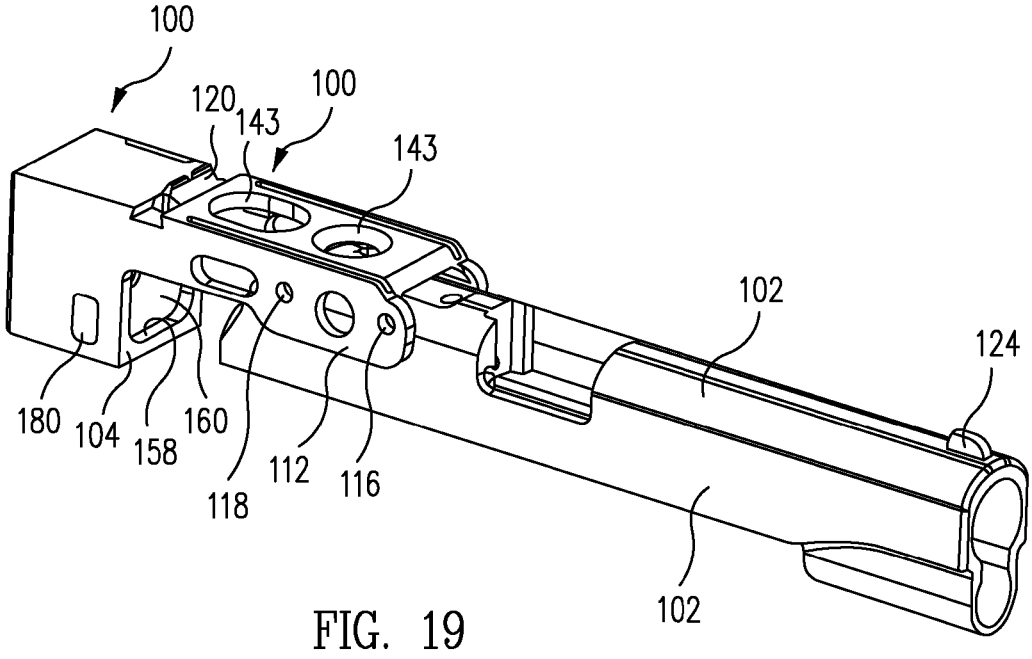
Figure 20:
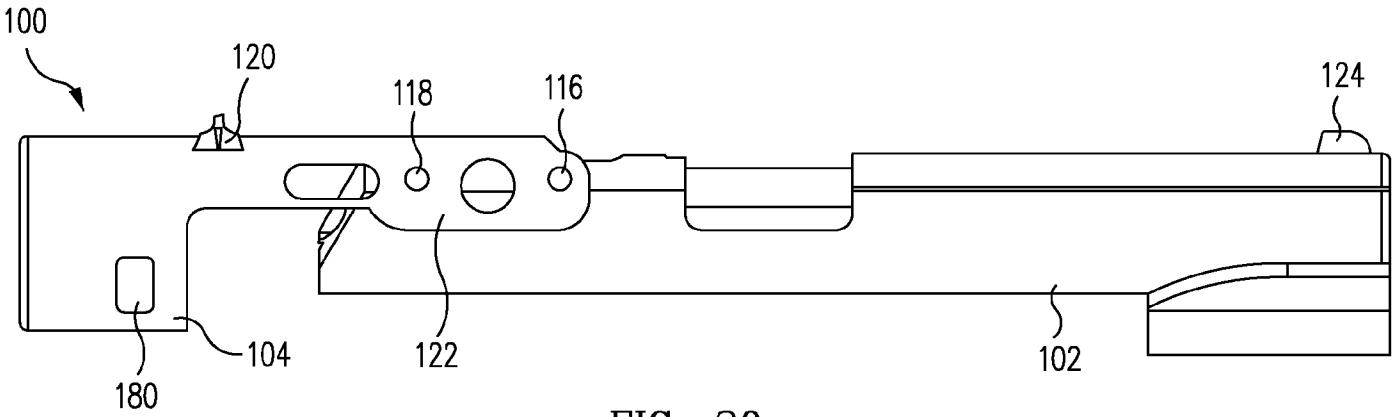
Figure 21:
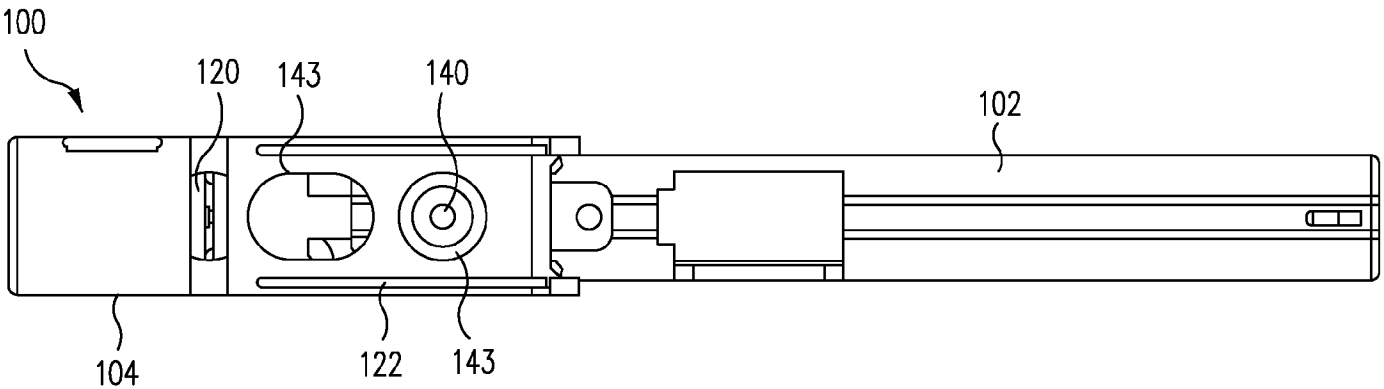

Referring now to FIG. 8, the illuminated dot generator of the sight 300 comprises a rearward facing parabolic mirror or reflector 315, and an LED point light source 362 mounted on a PCB 317 disposed to face toward the reflector 315. As illustrated in FIG. 8, the PCB 317 and light source 362 are arranged such that light from the light source 362 radiates forwardly toward the parabolic reflective surface of the reflector 315 and is thereby reflected as a collimated beam of light rearward through the rectangular aperture 353 of the sight 300. The path taken by the light rays in an embodiment 300 is illustrated diagrammatically in FIG. 11. The result is a collimated plane wave that is seen by the user as an illuminated dot focused at infinity.

The parabolic reflector 315 may be constructed of a variety of materials and may be configured in a wide variety of ways. For example, the reflective surface may be integrated into a molded plastic part, or it may be a separate component that is affixed to a frame or other structure. As illustrated in, e.g., FIGS. 9-11, the reflector 315 may incorporate alignment features, such as forward extending protrusions 319 on the rear of the reflector 315 for aligning the reflector 315 in the housing 304, and, for example, cylindrical bores 321 extending into the front of the reflector 315 for aligning the PCB 317 and light source 362 with the reflective surface of the reflector 315.

FIGS. 17-22 are perspective views of a "refractive" sight 100 in accordance with an embodiment of the invention, shown mounted at a rear end of a slide 102 of an associated automatic pistol. The remainder of the pistol, such as a hammer, grip, trigger, and the like are omitted for clarity. This embodiment includes mechanisms that allow the user to adjust the elevation of the sight 100 in the field.

Figure 22:
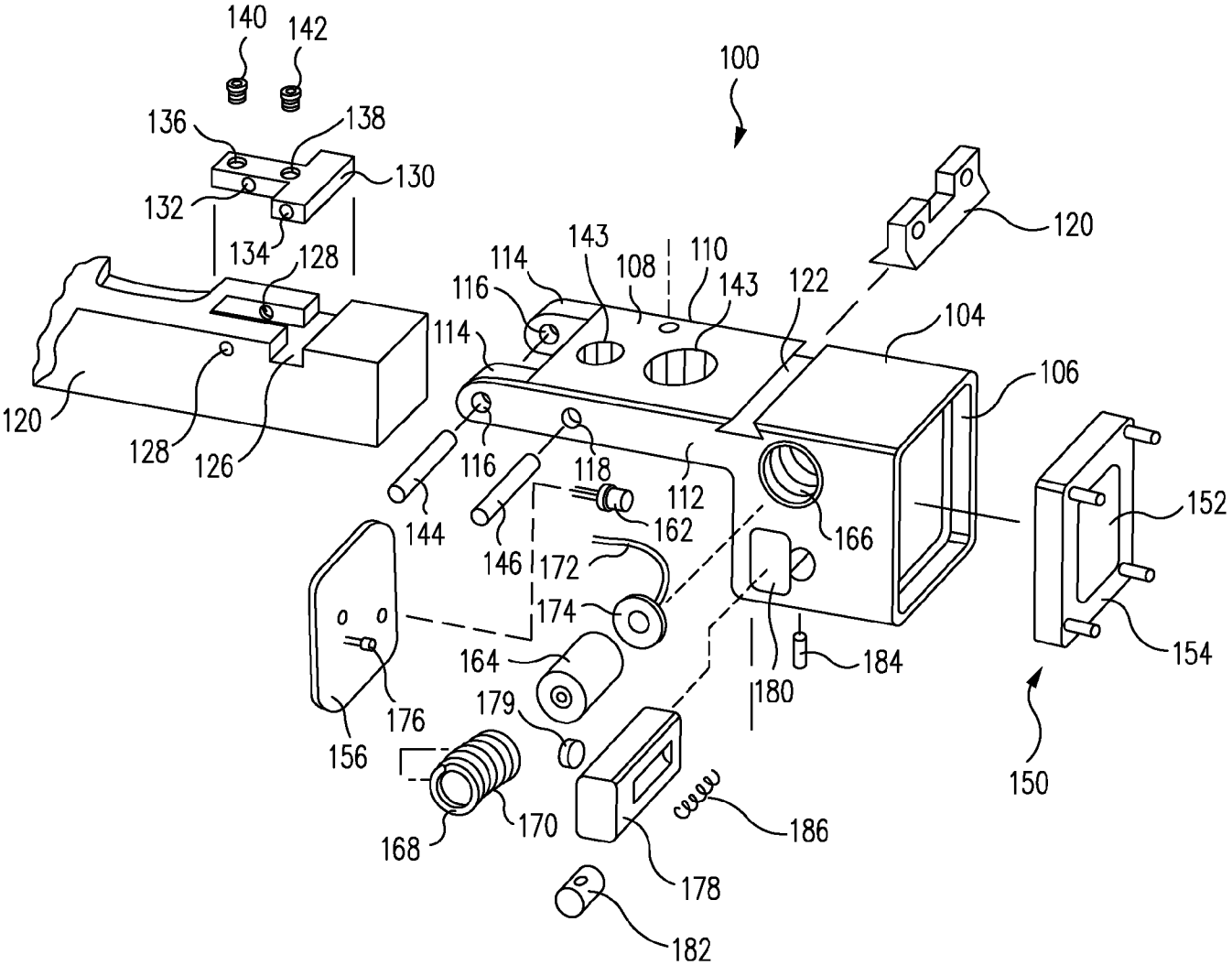

With reference to the exploded view of FIG. 22, the sight 100 comprises a generally rectangular housing 104 having a stepped, rectangular opening 106 at a rear end thereof, an upper surface 108, and a forwardly protruding portion 110 that defines a pair of ears 112 that extend downward so as to straddle a rear end of the pistol slide 102. Each of the ears 112 includes a lug 114 at the front end thereof, and the lugs 114 include a pair of respective front mounting pin apertures 116 that are coaxial with each other. A second pair of rear coaxial mounting pin apertures 118 is disposed in the ears 112 rearwardly of the front mounting pin apertures 116.

In one embodiment, in order to accommodate the mounting of the sight 100, the rear portion of the slide 102 may be modified. First, the rear sight 120 of the pistol is removed from a corresponding transverse notch in the slide 102 and reinstalled in a corresponding transverse slot 122 disposed in the upper surface 108 of the housing 104. This permits the rear sight 120 to be used in cooperation with the front sight 124 located at the front end of the slide 102 to sight the pistol on a target in the conventional manner.

As illustrated in FIG. 22, after the notched rear sight 120 is removed from the slide 102 and relocated as above, a T-shaped recess 126 is formed in the upper surface of the slide 102, with the cross-bar of the T being disposed at the formerly location of the groove in which the notched rear sight 120 was formerly mounted, and with the vertical leg of the T extending forwardly. Coaxial mounting pin apertures 128 are formed in the slide 102 on opposite sides of the vertical leg of the T-shaped recess. A T-shaped pivot block 130 is then disposed in the T-shaped recess 126. The pivot block 130 is shaped correspondingly to the T-shaped recess 126 in the slide 102, and includes first and second transverse mounting pin apertures 132 and 134 and first and second threaded vertical apertures 136 and 138. First and second elevation adjustment setscrews 140 and 142 are respectively disposed in the vertical apertures 136 and 138.

During assembly of the sight 100 to the rear of the slide 102, the front mounting pin apertures 116 in the ears 112 of the housing 104 are coaxially aligned with the mounting pin apertures 128 in the slide 102 and the first transverse mounting pin aperture 132 in the pivot block 130, and a front mounting pin 144 is then inserted through apertures 116, 128, and 132 with a tight, frictional fit. Similarly, the rear mounting pin apertures 118 in the housing 104 are coaxially aligned with the second transverse mounting pin aperture 134 in the pivot block 130, and a rear mounting pin 146 is then inserted through apertures 118 and 134 with a tight, frictional fit. This arrangement permits the sight 100 to pivot up and down on the forward mounting pin 144 (e.g., relative to the slide 102) for elevation adjustment of the sight 100, and the sight 100 is locked into the desired elevation position by suitable tightening of the first and second elevation adjustment setscrews 140 and 142. Tool access to the setscrews 140 and 142 may be provided by suitably located access openings 143 located in the upper surface 108 of the housing 104.

The design of this sight 100 contemplates that all azimuth adjustment of the sight 100 be effected when it is initially installed on the gun, and hence, provides only for elevation adjustment by the user. During construction and assembly of each sight 100, at the stage at which it is mounted to the slide 102 of the gun, special care is taken to achieve very accurate azimuth alignment of the illuminated dot to the bore of the weapon. However, the mechanical design of the sight 100 does allow the sight, after removal of the rear mounting pin 146, to be rotated upward by 90 degrees, which permits the sight 100 and slide 102 to be removed from the weapon for cleaning and to provide access to the battery compartment of the sight 100 described below.

The optical portion of the sight 100 comprises a lens assembly 150 retained in the stepped, rectangular opening 106 at the rear end of the housing 104. In one embodiment, the lens assembly 150 comprises an aspheric lens 152 having a convex outer surface and a planar inner surface that is retained in a rectangular mounting bezel 154. In one embodiment, the lens 152 is molded of an acrylic plastic that is dyed red and provided with a hard coating to protect the exterior surface thereof.

The lens assembly 150 defines an active rectangular aperture that, in one embodiment, may be about 1.0 in. high by about 0.9 in. wide, with corners having a radius of about 3/16 inch. The aperture is centered behind the slide 102, with its center located approximately 0.25 in. below the axis of the barrel of the gun.

As illustrated in FIG. 22, a PCB 156 (e.g., used for light source control) is disposed opposite to the lens assembly 150 in a front opening 158 (see FIG. 19) at the front of a lower rear interior compartment 160 defined by the housing 104, and point light source 162, such as a light emitting diode or laser diode, is mounted thereon such that it is located substantially coaxially on the optical axis of the lens 152. The light radiating from the light source 162 travels directly through the lens 152 as a plane wave and appears to the user as a red dot (e.g., a small uniform disk of light focused at infinity). In one embodiment, the light source 162 may comprise a laser diode capable of emitting red light at a wavelength of 650 nm, which yields a 1 minute of angle (MOA) red dot when viewed through the aspheric lens 152. Light sources with other wavelengths and/or angles may be used in other embodiments.

In FIG. 22, the light source 162 is powered by a small battery 164, such as a ⅓ N cell lithium or NiCad battery, contained in a cylindrical battery compartment 166 in the housing 104 and held therein by a small, threaded battery door 168 and compression spring 170. Power from the battery 164 is conveyed to the PCB 156 via a service loop of electrical wire 172 that couples between the PCB 156 and an internal battery contact 174.

In use, the brightness of the illuminated dot produced by the light source 162 may be automatically scaled to the ambient light level using a photodiode 176 that senses ambient light through the lens assembly 150 of the sight 100. The brightness level bias, i.e., the ratio of the brightness of the illuminated dot to the brightness of the ambient light may be scaled up or down through two orders of magnitude using a cross pin 178, which is retained in a rectangular transverse bore 180 (e.g., which may be implemented on a left and/or a right side of housing 104 as shown in FIGS. 17-22) in the housing 104 by an adjacent cylindrical plug 182 and friction pin 184, and is loaded by a spring 186 in a neutral position. The cross pin 178 is arranged such that depressing the cross pin 178 toward the right side of the housing 104 reduces (e.g., "scrolls down") the brightness of the light source 162, and depressing it left increases (e.g., "scrolls up") the brightness. In one embodiment, sight 100 may include a magnet 179 which may cooperate with a Hall effect sensor of sight 100 to permit sight 100 to detect a position of cross pin 178 (e.g., through operation of microcontroller 502).

The sight 100 may also be turned on and off by a depression of the cross pin 178, or alternatively, by a separate switch, and may remain on continuously, or alternatively, may remain on for a predetermined period of time, e.g., 24 hours, and then turn off automatically via a timer function incorporated in the PCB 156. In one embodiment, a longer "on" period may be implemented, together with the ability to turn the sight 100 off by a double or triple "click" of the cross pin 178. In one embodiment, a warning of a low battery condition in the sight 100 may be sensed by suitable voltage detection circuitry on the PCB 156 and signaled to the user by a continuous blinking of the illuminated dot. Convenient access to the cross pin 178 permits a user to easily pick up the weapon and instantly turn on the sight 100 as the weapon is brought to bear.

Figure 23:
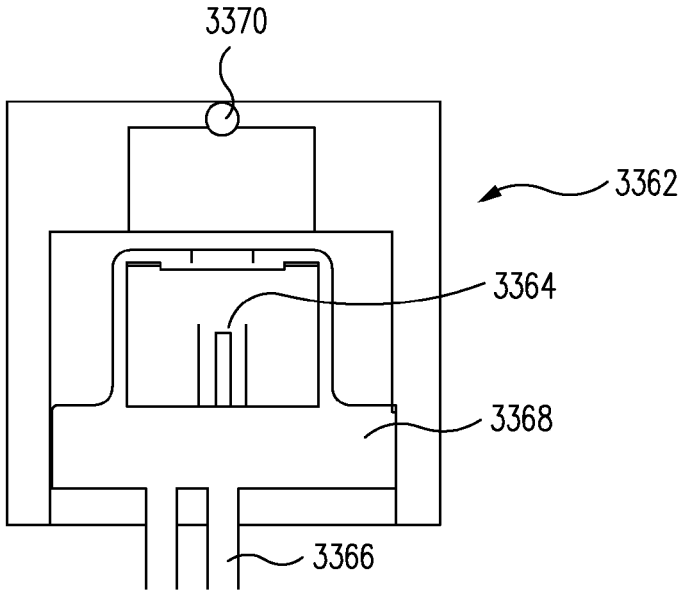
FIG. 23 illustrates a light source diode (LED) in accordance with an embodiment of the invention.
Figure 24:
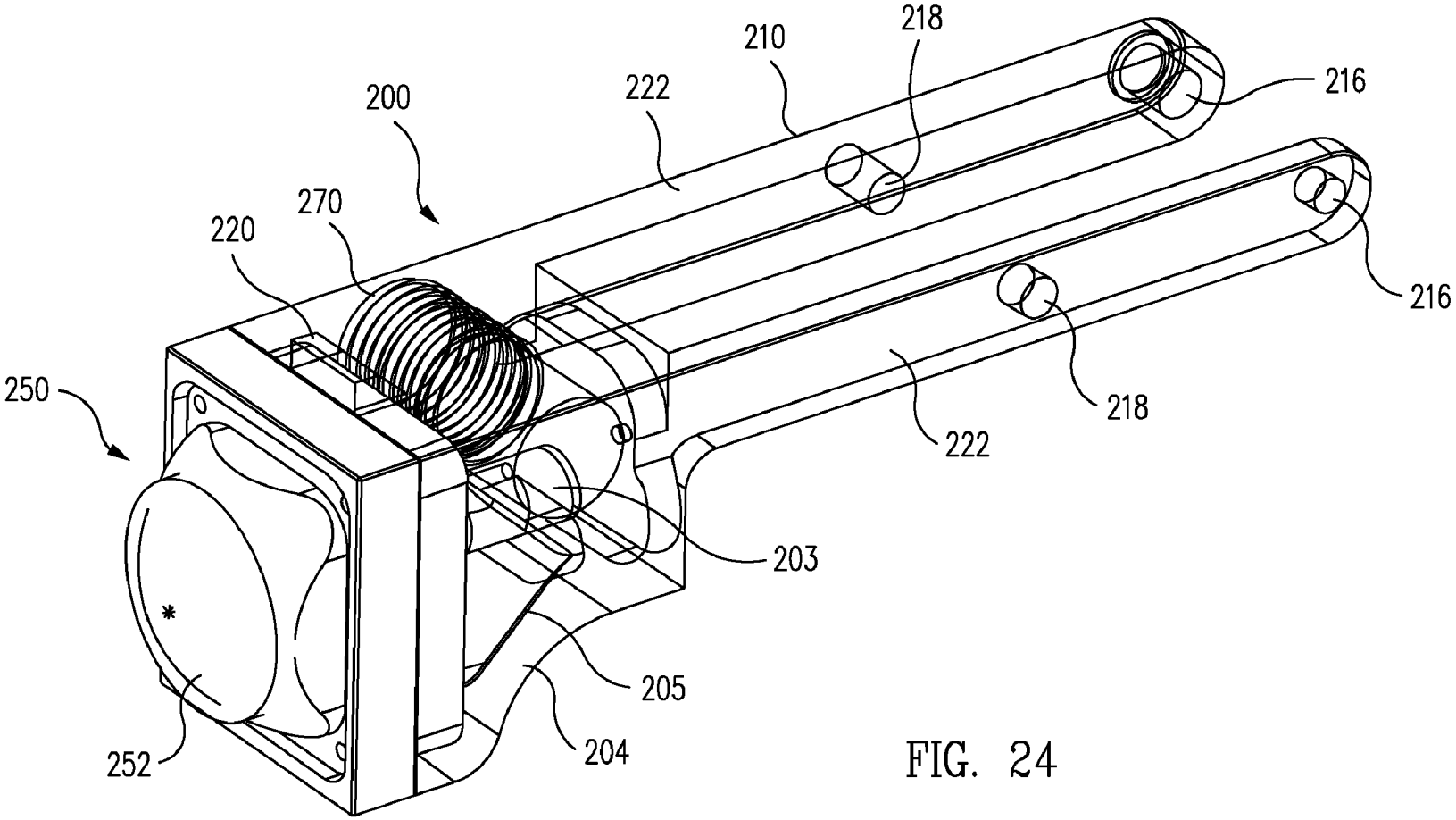
FIGS. 24-32 illustrate various additional implementations of gun sight employing a refractive optical implementation in accordance with embodiments of the invention.
Figure 32:
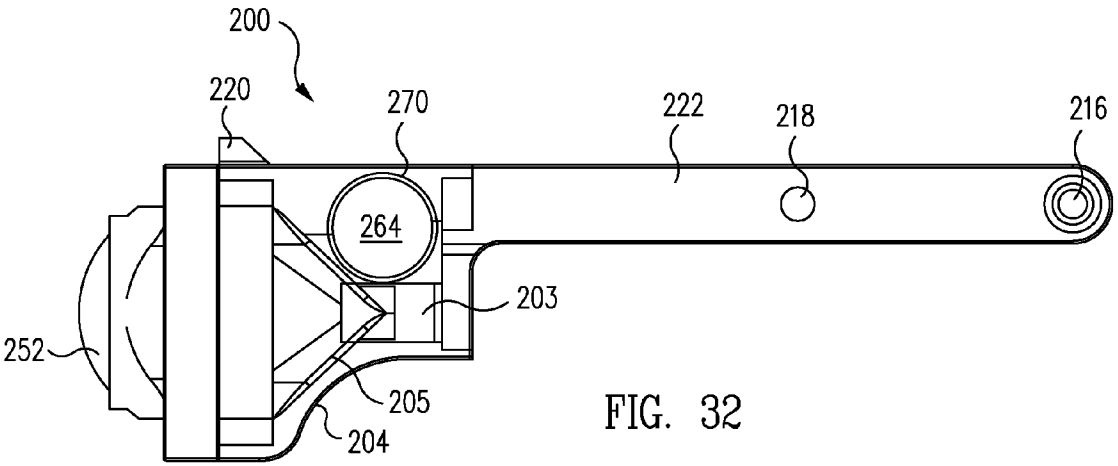
Figure 25:
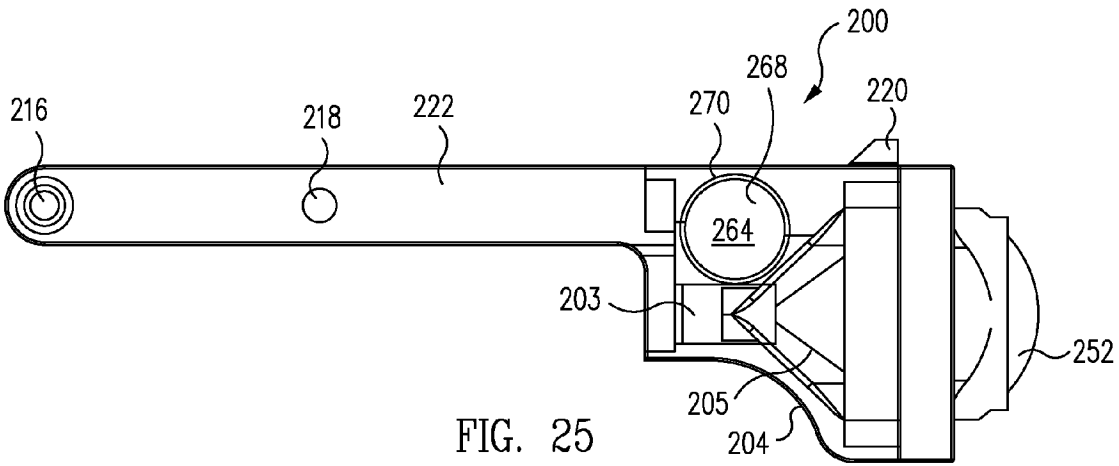
Figure 27:
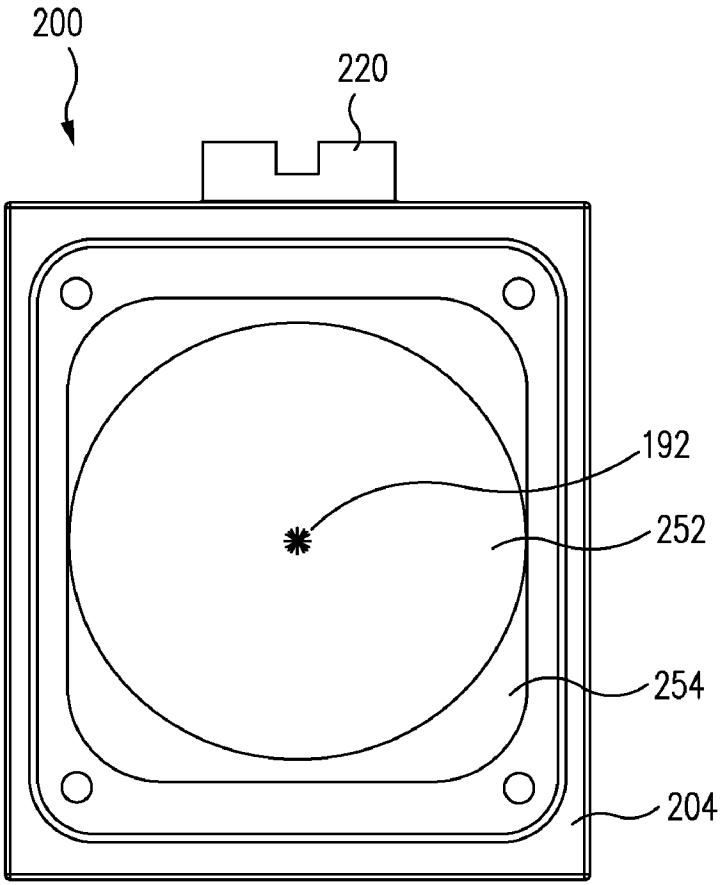

FIG. 23 is a cross-sectional view of an embodiment of a light emitting diode (LED) point light source 3362 in accordance with an embodiment of the invention. The LED light source 3362 may be used in any of the sights described herein. The LED light source 3362 comprises a light emitting diode junction 3364, which may be a laser diode in one embodiment, formed at the upper ends of a conductor 3366 of the device, which is hermetically sealed in a housing 3368. An opening in the upper end of the housing 3368 is closed with a spherical lens 3370, through which light generated by the device is radiated in a hemispherical direction.

Another embodiment of a refractive sight 200 in accordance with an embodiment of the invention is illustrated in FIGS. 24-28, wherein the housing 204 is shown as though transparent to reveal underlying structure, such as the battery compression spring 270. The sight 200 is similar in construction and operation to the sight 100 described above, but with the following exceptions. The forward protruding portion 210 of the housing 204 of the sight 200 may eliminate the transverse upper surface 108 of the sight 100 and instead comprises a pair of parallel, forwardly extending ears 222 that are adapted to straddle an elongated land 207 (see FIG. 28) mounted on the upper surface of the slide 202 of an associated pistol. The housing 204 may be secured to the slide 202 by appropriate pins (e.g., pin 244) extending through apertures 216 and 218. A rear sight 220 may be provided on housing 204 to permit aiming the associated pistol (e.g., in cooperation with a corresponding front sight 124) with conventional open sights if desired.

Figure 26:
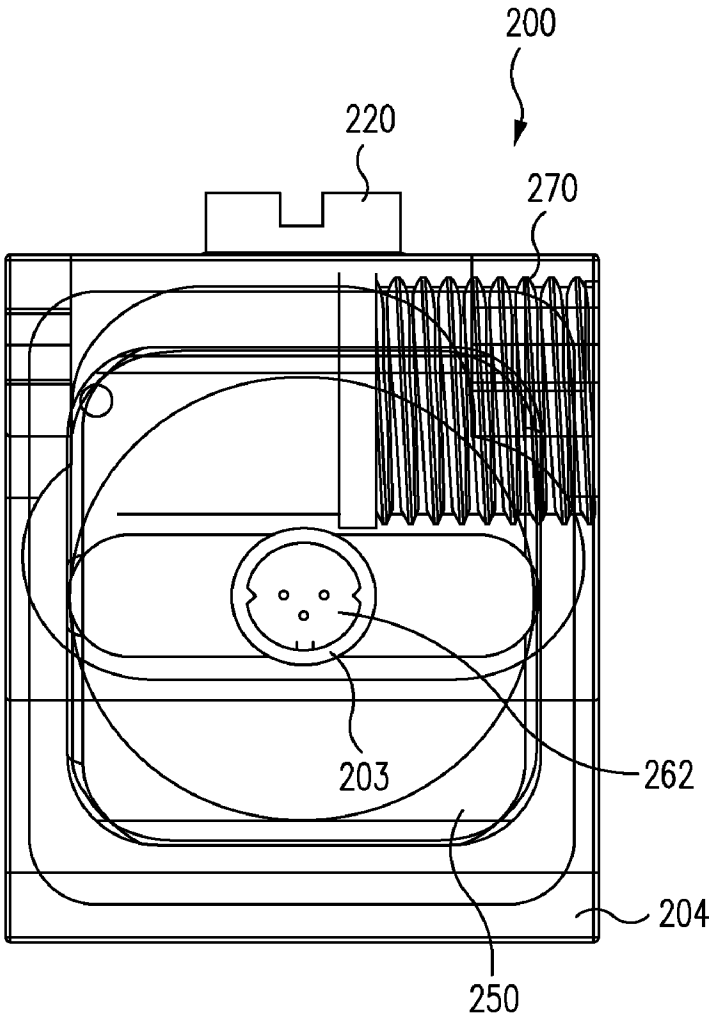
Figure 28:
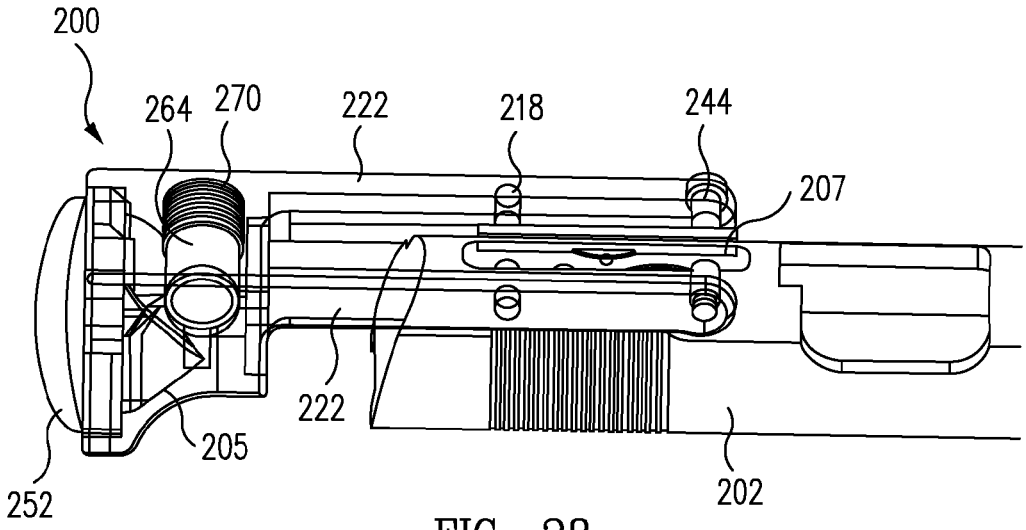
Figure 30:
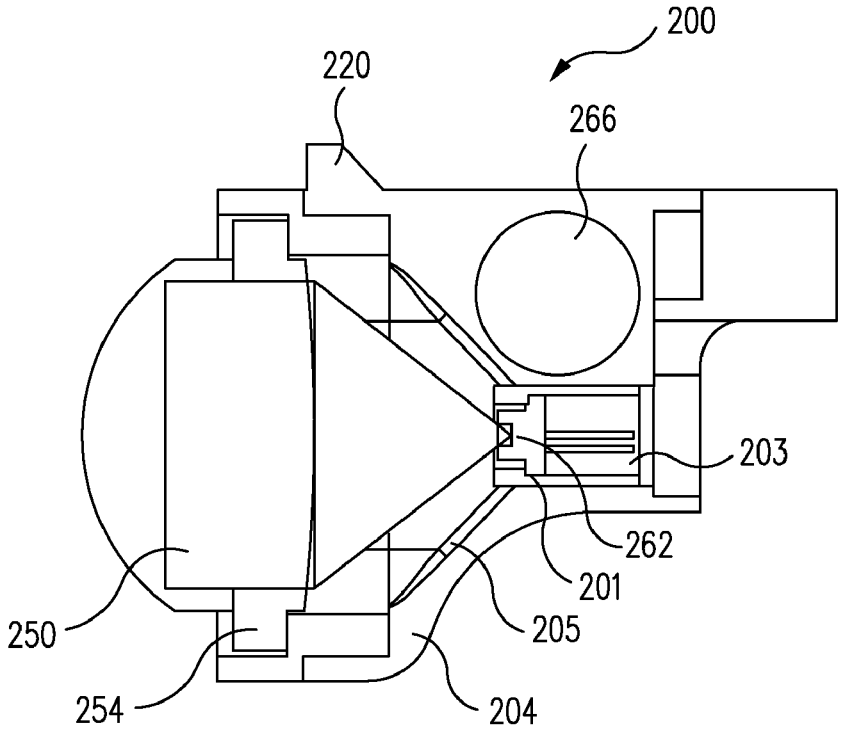
Figure 31:
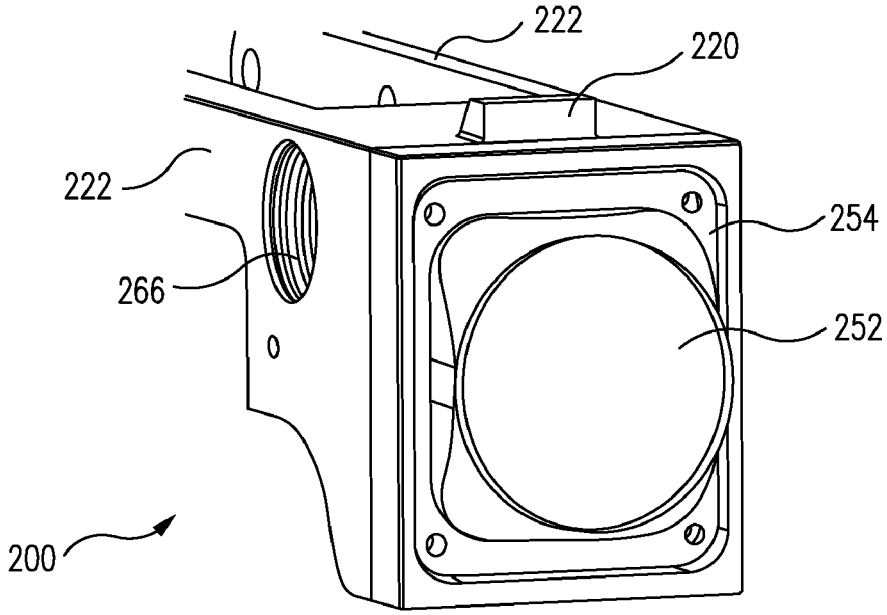

As illustrated in FIGS. 26 and 30, the LED point light source 262 of the sight 200 is disposed on a shoulder 201 of a cylindrical recess 203 that extends forwardly into a conical cavity 205 defined by the housing 204 to radiate rearwardly toward the lens 252 of the lens assembly 250 which is secured to the housing 204 by a perimeter surface 254. This arrangement permits the light source 262 to be more precisely located on the optical axis of the lens 252.

Figure 29:
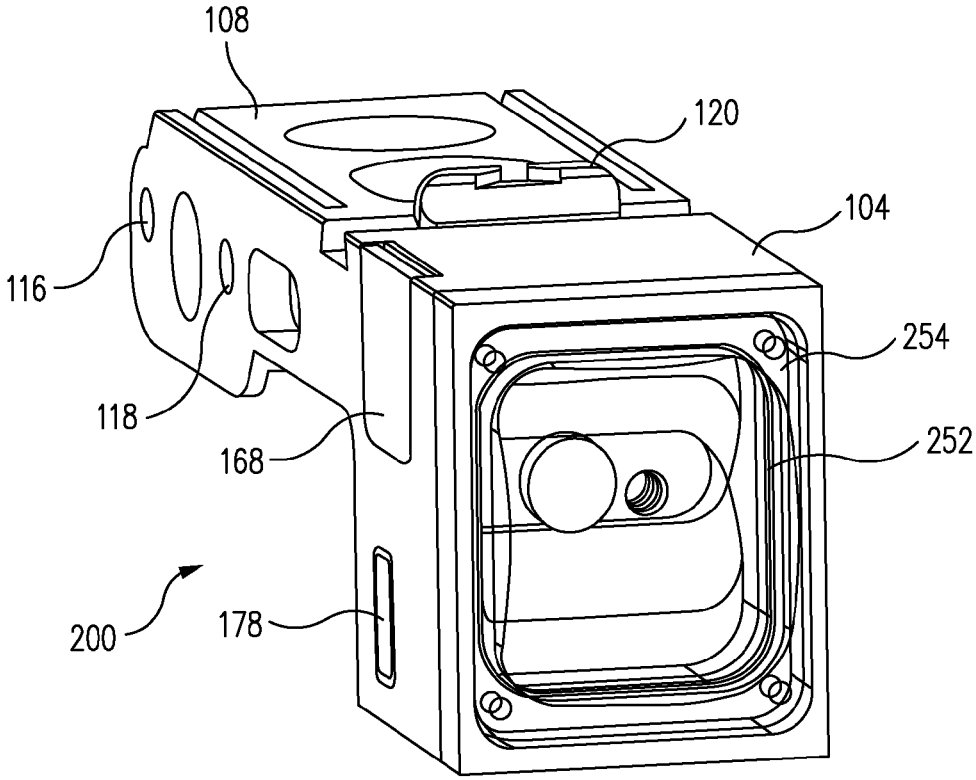

Light source 262 is powered by a small battery 264, such as a ⅓ N cell lithium or NiCad battery, contained in a cylindrical battery compartment 266 in the housing 204 and held therein by a small, threaded battery door 268 and a compression spring 270. As shown in FIG. 29, the particular optical implementation of sight 200 may be implemented in housing 104 of sight 100 if desired in one or more embodiments.

Figure 33:
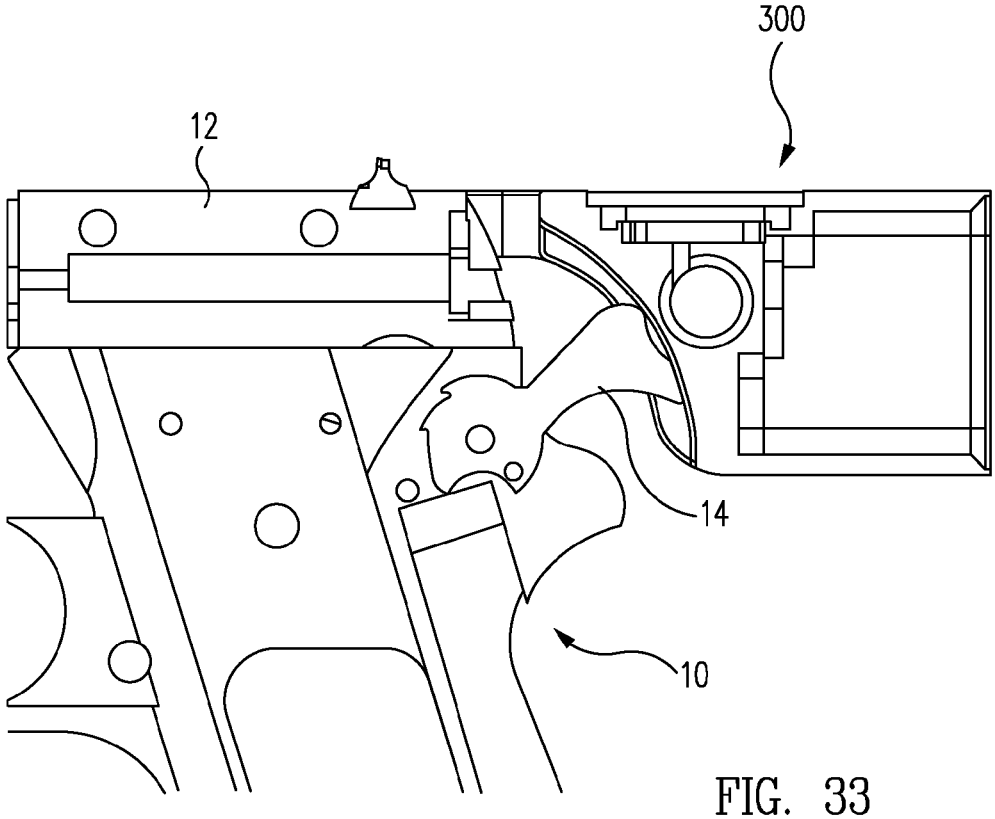
FIG. 33 illustrates an implementation of a gun sight which may be used with a pistol having a hammer in accordance with an embodiment of the invention.

Any of the guns sights described herein may be mounted on the slide 12 of an associated automatic pistol 10, e.g., a M1911 Colt/Browning automatic pistol. For example, as shown in FIG. 33, such pistols may incorporate an exposed hammer 14 located at the rear of the slide 12. A sight may mount at the rear of the slide 12 of the gun 10 so as to clear the hammer 14 as it moves in an arc from a fully cocked position, as illustrated in FIG. 33, to a fully forward position adjacent the rear end of the slide 12. The hammer 14 prevents mounting the sight directly to the rear face of the slide 12.

Figure 34:
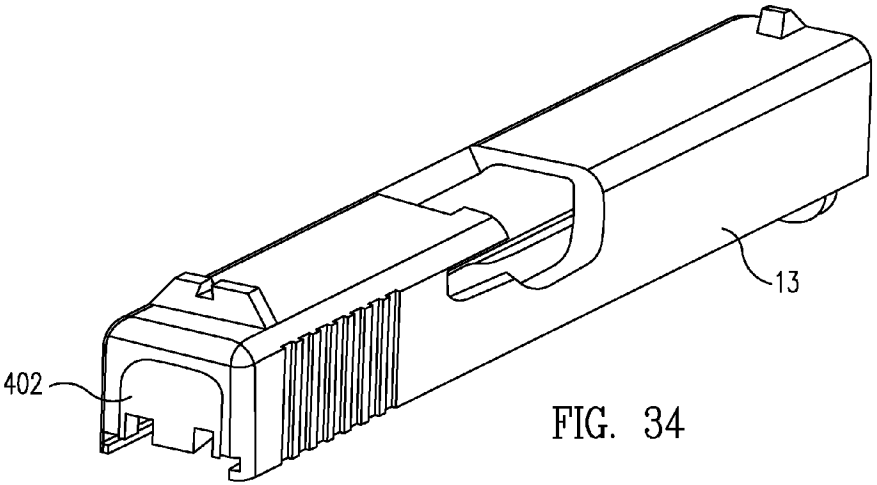
FIGS. 34-37 illustrate various implementations of gun sight which may be used with a hammerless or striker fired pistol in accordance with embodiments of the invention.

As will be appreciated, many firearms including many automatic and semi-automatic pistols do not have an external hammer 14, and instead, incorporate an internal mechanism for striking the firing pin of the weapon. These may be referred to as "hammerless" or "striker fired." As illustrated in FIGS. 34-37, any of the sights described herein may be adapted for use with such hammerless or striker fired pistols, and may be mounted directly to the rear face of the slide 13 in such cases. FIG. 34 illustrates the slide 13 of a hammerless automatic pistol. A removable flat plate at the rear of the slide 13 retains the firing pin. This plate may be replaced with an adapter plate 402 that facilitates attachment of the sight, such as a dovetail adapter plate. Various other structures may be used to attach the sight to a hammerless pistol in the desired location on axis with the barrel of the firearm such that it is aligned substantially co-axially with the longitudinal axis B (see FIG. 35) of the barrel of the weapon.

Figure 35:
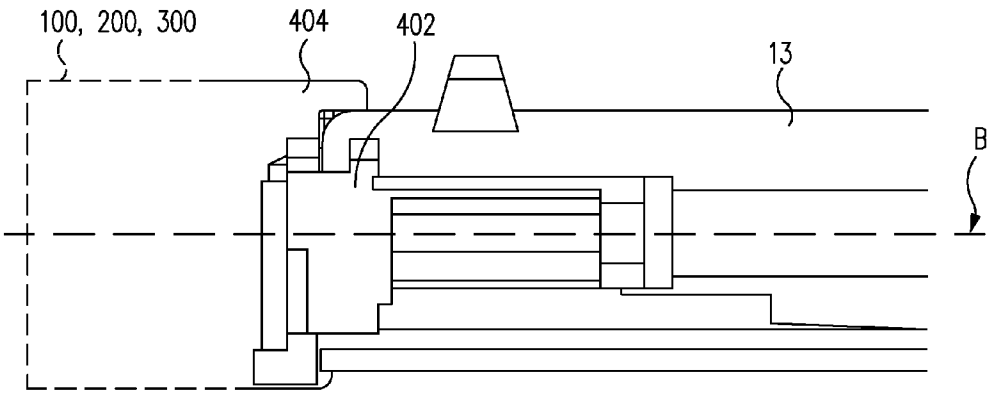
Figure 36:
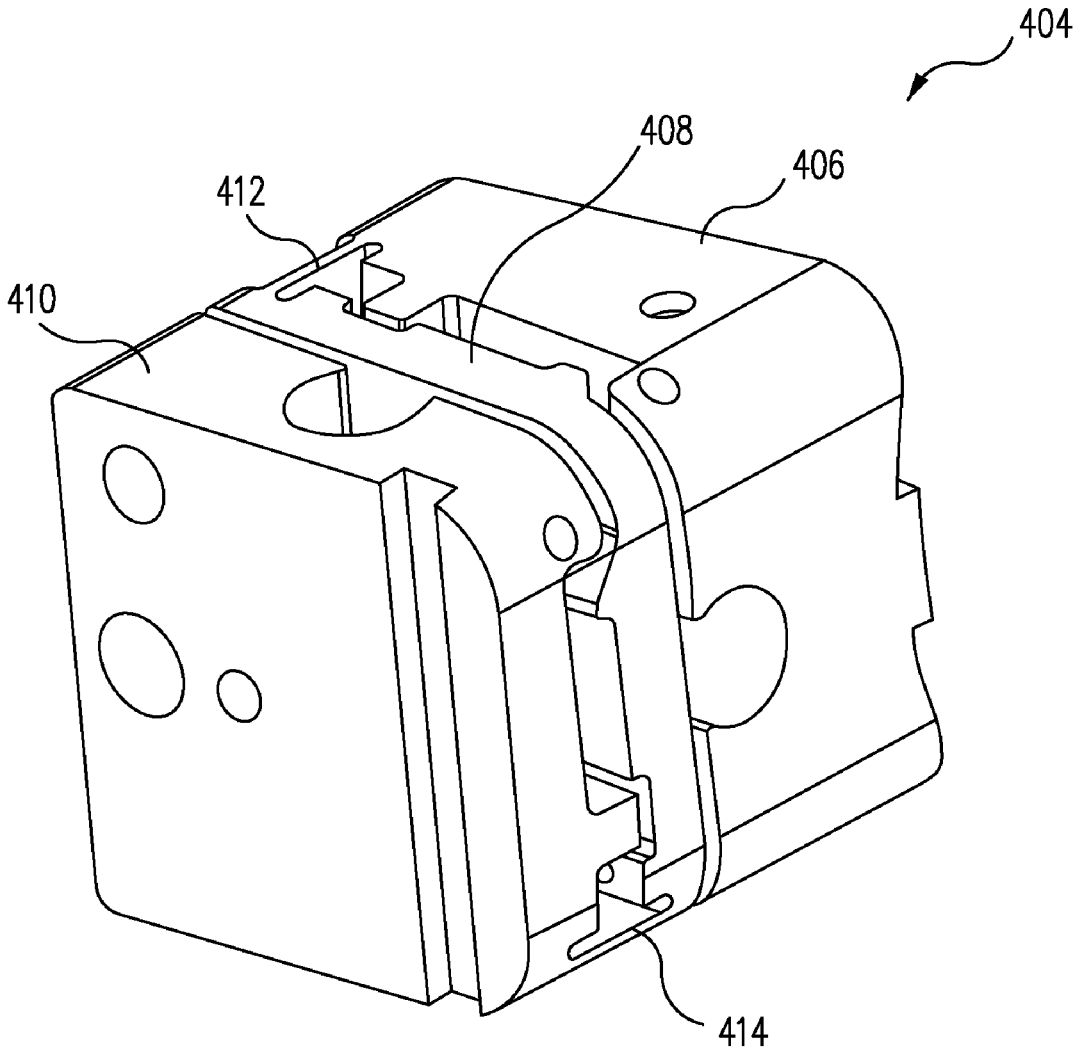

Various types of mechanisms may be used to provide for field adjustment where desirable. As illustrated in FIG. 35, in one embodiment a flexure 404 may be mounted to a back surface of the adapter plate 402, and the sight may be mounted to a back surface of the flexure 404. As illustrated in FIG. 36, the flexure 404 may comprise a block of a resilient material in one embodiment, e.g., a heat-treated steel alloy, that is machined or otherwise formed to incorporate the three leaves 406, 408, and 410 that are hinged relative to each other at respective edges disposed at approximately 90 degrees to each other.

Figure 37:
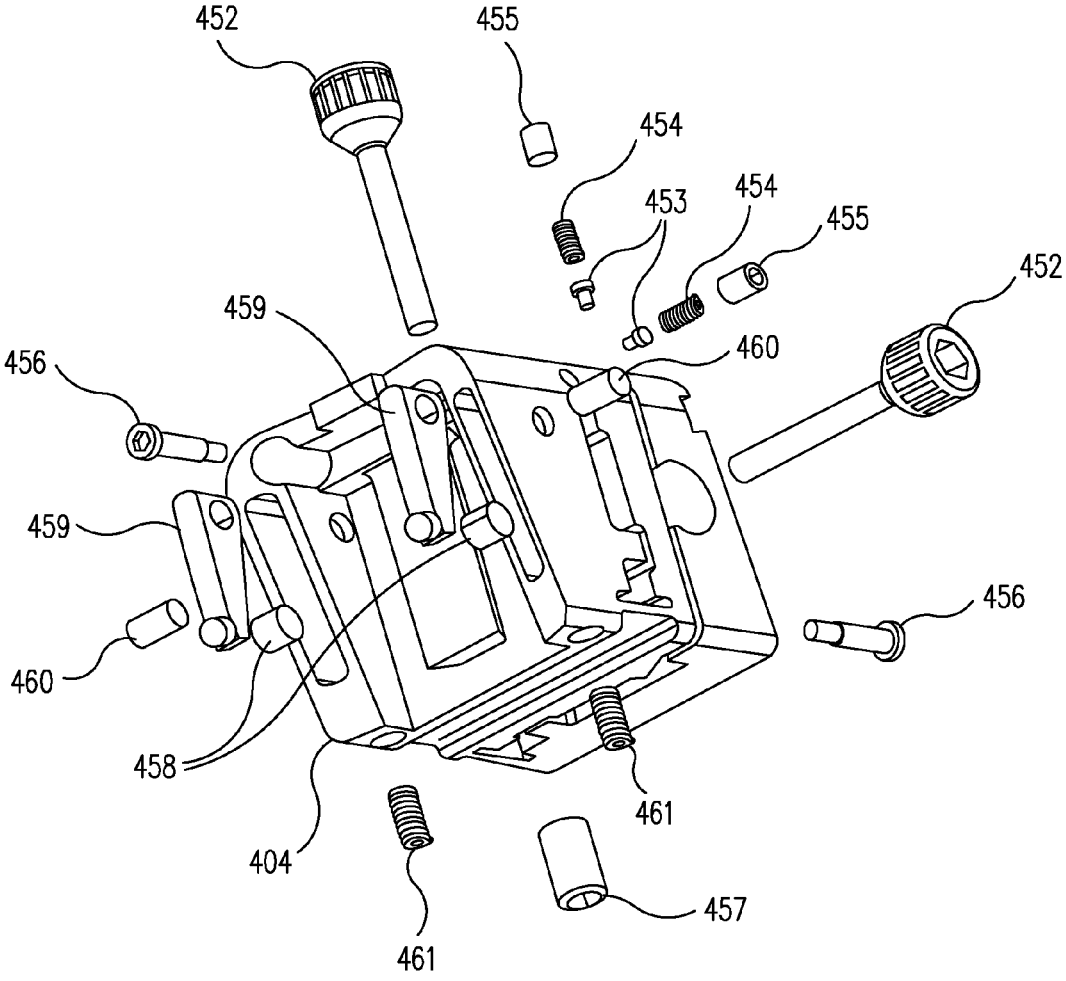

Thus, one leaf 406 is affixed to the back of the adapter plate 402, an intermediate leaf 408 is hinged horizontally at a solid hinge 412 relative to the first leaf 406 so as to provide azimuth adjustment, and a third leaf 410 is arranged to hinge vertically at a second solid hinge 414 relative to the intermediate leaf 408 so as to provide elevation adjustment. As illustrated in FIGS. 36 and 37, the flexure 404 may be assembled with adjustment screws 452, index plungers 453, pressure springs 454, set screws 455, over travel stops 456, adjustment locking nuts 457, securing wedges 458, securing clamps 459, dowel pins 460, and securing screws 461. Advantageously, adjustment screws 452 may permit the sight to be mounted to the rear surface of the third leaf 410 of the flexure 404 and then adjusted for both azimuth and elevation. It will be readily understood that a wide variety of other mechanisms may be used to provide for field adjustment of the sight. For example, systems using interchangeable prisms, cam mechanisms, spherical bearings, or T-blocks may be used to provide varying degrees of adjustability on the different axes.

With all sighting devices, including open reflex sights and OEGs, that use an illuminated dot that is viewed through an aperture, if the weapon is significantly out of alignment with the target or if the user's eye is too far out of alignment with the aperture the illuminated dot may not be visible to the user. This is a particular problem in very low light conditions where the user cannot see the firearm as it is brought into firing position, and thus lacks visual cues to bring the weapon into alignment.

It will be readily understood that the larger the aperture 353 the easier it will be for the user to align the sight with the user's dominant eye such that the collimated beam of light projected through the aperture can be seen by the user. Positioning the sight behind the slide of a pistol or the frame of a revolver allows for the largest possible aperture that will not interfere with balance and profile of the weapon. For example, an aperture that extends substantially the width of the slide of the pistol and vertically from the top of the slide down to the top of the user's hand maximizes the size of the aperture without interfering with use of the iron sights on the top of the slide and without a bulky projection from the top or side of the firearm.

In an exemplary embodiment of the invention, an indicator may be included in the gun sight to provide a visual cue to help the user obtain a general alignment of the firearm with the target. If the firearm is positioned such that the user cannot see the illuminated dot, an indicator dot in a different color than the illuminated dot may be provided. This indicator dot may be visible, for example, at an edge of the aperture of the gun sight, such that it indicates the direction the firearm needs to be moved to bring the user's eye into correct alignment to acquire the illuminated dot. For example, if the firearm is too low for the user to see the illuminated dot, the indicator dot may appear at the top edge of the aperture, indicating that the firearm needs to be raised higher to bring the sight into correct alignment with the user's eye.

It has long been understood that accurate and effective use of firearms, particularly in high-stress situations such as combat or tactical response, requires extensive training so that the user's develops sufficient muscle memory that their actions become unconscious. Unfortunately, firearms training is extremely expensive in large part because of the cost of ammunition and limited availability of training facilities such as shooting ranges where live ammunition or training blanks may be used. "Dry firing" is the firing of a firearm without either live ammunition or a training blank in the chamber. Dry fire training eliminates the cost of ammunition or blanks, can be conducted virtually anywhere, and allows trainees to conduct an unlimited number of repetitions of the movements involved in bringing their weapon to bear on a target in every conceivable scenario. Thus, there is a need for a gun sight that can be used as a "dry firing" training tool either on its own or as part of a complete firearms or tactical training system.

In one exemplary embodiment, a gun sight of any type may be equipped with a detector, such as an accelerometer (e.g., accelerometer 510), an audio detector or any other suitable device, that can detect the operation of the weapon's firing mechanism such as the fall of the hammer 14. If the detector is activated, when the user pulls the gun's trigger the detector will detect the operation of the firing mechanism, and cause some feedback (e.g., a visible, audible, tactile, or other type of indication) to be output to the user at the instant the weapon would fire if a round was chambered. For example, in one embodiment, a sensor such as accelerometer 510 may provide one or more signals to microcontroller 502 in response to operation of the firing mechanism. In response to the one or more signals, microcontroller 502 may cause appropriate components of the gun sight to provide the feedback.

The feedback provided to the user could take many forms. In one exemplary embodiment, the illuminated dot 192 of the gun sight may increase in brightness for an instant to indicate to the user that a shot has been fired. When the illuminated dot 192 flashes, the user's brain registers the location of the dot 192 relative to the aim point 190 at the instant the trigger is pulled. This allows the user to see where the gun was aimed at the instant the weapon would have fired. In another exemplary embodiment, the illuminated dot 192 briefly changes color at the instant the weapon was fired. Persons of ordinary skill in the art will understand that a wide variety of audio, visual, or tactile indicators may be used to indicate to the user the instant that the weapon would have fired if ammunition was being used. In one exemplary embodiment, data regarding the location, orientation, movement, and aim point relative to a target can be collected by sensors located on the weapon or in the target field at the instant of firing. This data can then be analyzed to determine the accuracy of the dry fire shots.

Such a system allows users to train effectively by dramatically increasing the number of times they bring their weapon to bear on a target, while providing immediate feedback to the user regarding their accuracy. Regular use of this dry firing technique may greatly improve the user's marksmanship without having to expend ammunition or to train at a secure practice range. This dry fire training technique also allows users to train under more realistic conditions because it allows the user to target any object that may be a threat. For combat and law enforcement training, the ability to conduct firearms training in which the user is targeting a live human being is particularly important to realistically simulate conditions that may be encountered in the field and train users to overcome their natural resistance to targeting a human being.

As those of skill in the art will appreciate, the gun sights described herein provide a number of distinct advantages, relative to the various gun sights of the prior art. Unlike prior art OEGs and open reflex sights, the conventional open sights on the firearm are not obscured and the balance of the weapon is not altered significantly. The inventive gun sights provide for fast target acquisition in combat situations while allowing the user to maintain a wide field of view, avoid tunnel vision, and maintain situational awareness. Because of their positioning and low sight profile, the gun sights disclosed herein may be used with regular pistol holsters and may be used for concealed carry.

Where applicable, the various components set forth herein can be combined into composite components and/or separated into sub-components without departing from the spirit of the present invention. Similarly, where applicable, the ordering of various steps described herein can be changed, combined into composite steps, and/or separated into sub-steps to provide features described herein.

Embodiments described above illustrate but do not limit the invention. It should also be understood that numerous modifications and variations are possible in accordance with the principles of the present invention. Accordingly, the scope of the invention is defined only by the following claims.

What is claimed is:

1. An optical sight for a handgun, the sight comprising:

a light source;

an optical system that projects an approximately collimated beam of light from the light source toward a user of the sight to create an image of an illuminated reticle; and wherein the optical sight is positioned behind a barrel of the handgun such that it is generally centered on a longitudinal axis of the barrel of the handgun.

2. The sight of claim 1, wherein the illuminated reticle is a small uniform disk of light focused at infinity.

3. The sight of claim 1, wherein the handgun is a pistol, wherein the optical sight is disposed substantially below a plane formed by a top of a slide of the pistol such that open sights of the pistol are not obscured.

4. The sight of claim 1, wherein the handgun is a revolver, wherein the optical sight is disposed substantially below a plane formed by a top of a frame of the revolver such that open sights of the revolver are not obscured.

5. The sight of claim 1, wherein the optical sight comprises an aperture through which the illuminated reticle is viewed that extends substantially a width of a frame of the handgun.

6. The sight of claim 1, wherein the optical system comprises a substantially parabolic mirror.

7. The sight of claim 1, wherein the optical system comprises a lens adapted to refract and focus the light toward the user.

8. The sight of claim 1, wherein the handgun is a pistol, wherein the optical system is disposed within a housing that is attached to a slide of the pistol such that the optical system can be rotated upward to allow the slide to be removed from the pistol.

9. The sight of claim 8, wherein the housing is attached to the slide of the pistol by a mounting mechanism that is integrated with the housing.

10. The sight of claim 9, wherein the mounting mechanism comprises:

a pair of mounting ears adapted to extend substantially parallel to the longitudinal axis of the barrel of the pistol and substantially straddle the slide of the pistol on opposite sides thereof; and at least one substantially transverse pin adapted to couple the mounting ears to the slide.

11. The sight of claim 1, wherein the handgun is a pistol comprising a hammer, wherein the sight comprises a mounting mechanism adapted to position the sight substantially behind the hammer.

12. The sight of claim 1, wherein the optical system is disposed within a housing that is mounted such that it can be removed from the handgun without use of tools.

13. The sight of claim 1, wherein the light source is a light emitting diode (LED).

14. The sight of claim 1, further comprising a microcontroller adapted to adjust a brightness of the light source.

15. The sight of claim 14, further comprising a user control, wherein the microcontroller is adapted to adjust the brightness of the light source in response to the user control.

16. The sight of claim 14, further comprising an ambient light sensor, wherein the microcontroller is adapted to adjust the brightness of the light source in response to the ambient light sensor.

17. The sight of claim 14, further comprising a sensor adapted to detect an operation of a firing mechanism of the handgun, wherein the microcontroller is adapted to provide feedback to the user in response to the detected operation.

18. The sight of claim 17, wherein the feedback is an increase in the brightness of the light source.

19. The sight of claim 14, further comprising a sensor adapted to detect a motion of the sight, wherein the microcontroller is adapted to selectively provide power to an electronic component of the sight in response to the detected motion.

20. The sight of claim 19, wherein the sensor is an accelerometer.

* * * * *